US011434705B2

(12) United States Patent
Hansen et al.

(10) Patent No.: US 11,434,705 B2
(45) Date of Patent: Sep. 6, 2022

(54) TUBULAR MAKE-UP AND DELIVERY SYSTEM

(71) Applicant: Summit Laydown Services Inc., Fort Worth, TX (US)

(72) Inventors: Mitchel D. Hansen, Aledo, TX (US); Kevin Bradley Jonah, Calgary (CA)

(73) Assignee: SUMMIT LAYDOWN SERVICES INC., Fort Worth, TX (US)

( * ) Notice: Subject to any disclaimer, the term of this patent is extended or adjusted under 35 U.S.C. 154(b) by 0 days.

(21) Appl. No.: 16/950,650

(22) Filed: Nov. 17, 2020

(65) Prior Publication Data

US 2022/0018197 A1 Jan. 20, 2022

Related U.S. Application Data

(60) Provisional application No. 63/079,748, filed on Sep. 17, 2020, provisional application No. 63/051,774, filed on Jul. 14, 2020.

(51) Int. Cl.
*E21B 19/15* (2006.01)
*E21B 19/20* (2006.01)

(52) U.S. Cl.
CPC ..... *E21B 19/155* (2013.01); *E21B 19/20* (2013.01)

(58) Field of Classification Search
CPC ..... E21B 19/155; E21B 19/20
USPC ..... 414/22.51–22.71
See application file for complete search history.

(56) References Cited

U.S. PATENT DOCUMENTS 2,958,430 A * 11/1960 Robishaw ..... E21B 19/155 414/22.52
3,254,776 A * 6/1966 Brown ..... E21B 19/155 193/17
4,051,956 A * 10/1977 Teague ..... E21B 19/15 414/746.4

(Continued)

FOREIGN PATENT DOCUMENTS

RU 2217573 11/2003
RU 2446267 3/2012

(Continued)

OTHER PUBLICATIONS

NEXTgen Well Construction "Optimizing Well Construction Through Integration & Simultaneous Operations", Presentation, 2015, 24 pages.

(Continued)

*Primary Examiner* — Lynn E Schwenning
(74) *Attorney, Agent, or Firm* — Jackson Walker LLP; Christopher J. Rourk

(57) ABSTRACT

A system for assembling drilling tubulars, comprising a tiering rack system configured to receive a plurality of sections of drilling tubulars and to selectively provide an individual drilling tubular section. A casing feed and bucking skid system coupled to the tiering rack system and configured to receive the individual drilling tubular section and to combine the individual drilling tubular section with a second individual drilling tubular section. A tubular delivery catwalk system coupled to the casing feed and bucking skid system and configured to receive the combined drilling tubular sections and to transport the combined drilling tubular sections to a drilling rig by elevating on at least two elevating supports.

18 Claims, 25 Drawing Sheets

(56) References Cited

U.S. PATENT DOCUMENTS 4,380,297 A * 4/1983 Frias ..... E21B 19/15 211/70.4
4,382,591 A * 5/1983 Minnis ..... E21B 19/155 269/156
4,453,872 A * 6/1984 Frias ..... E21B 19/15 198/719
4,486,137 A 12/1984 Buckner
4,907,732 A * 3/1990 Jones ..... B23K 31/027 198/300
6,705,414 B2 * 3/2004 Simpson ..... E21B 15/003 175/52
7,404,697 B2 * 7/2008 Thompson ..... E21B 19/155 414/22.58
7,473,065 B2 * 1/2009 Wells ..... E21B 19/155 414/22.57
7,614,492 B2 * 11/2009 Muse ..... E21B 19/15 198/468.6
7,992,646 B2 * 8/2011 Wright ..... E21B 19/155 166/380
8,113,762 B2 * 2/2012 Belik ..... E21B 19/15 414/746.4
8,469,085 B2 * 6/2013 Orgeron ..... F16L 1/19 166/77.51
8,888,432 B1 * 11/2014 Guidroz ..... E21B 19/155 414/22.54
8,950,996 B2 * 2/2015 Hilton ..... E21B 19/14 414/22.55
8,998,551 B2 * 4/2015 Guillory, Jr. ..... E21B 19/155 414/22.57
9,410,385 B2 * 8/2016 Childers ..... E21B 19/155
10,060,203 B2 * 8/2018 Dore ..... E21B 19/15
10,329,788 B2 6/2019 Jonah et al.
10,465,456 B2 * 11/2019 Gupta ..... E21B 19/15
10,519,729 B2 * 12/2019 Jonah ..... E21B 19/165
10,612,323 B2 * 4/2020 Childers ..... E21B 19/155
10,900,300 B2 * 1/2021 Folk ..... E21B 19/14
2007/0221385 A1 * 9/2007 Braun ..... E21B 19/155 166/379
2009/0056932 A1 * 3/2009 Lesko ..... E21B 19/15 166/77.52
2009/0252576 A1 * 10/2009 Gerber ..... E21B 19/00 414/22.54
2011/0091304 A1 * 4/2011 Tetley ..... B41F 15/0872 254/133 R
2013/0336748 A1 * 12/2013 Hilton ..... E21B 19/155 414/22.62
2015/0184472 A1 * 7/2015 Miranda ..... E21B 19/155 414/22.58
2015/0259992 A1 * 9/2015 Forbes ..... E21B 19/155 414/22.61
2016/0251916 A1 * 9/2016 Arbelaez ..... E21B 19/155 414/22.59
2016/0356105 A1 12/2016 Jonah et al.
2017/0247902 A1 8/2017 Jonah et al.
2018/0328125 A1 11/2018 Folk
2019/0017334 A1 * 1/2019 Loeyning ..... E21B 19/16
2020/0131867 A1 4/2020 Jonah et al.
2020/0240217 A1 7/2020 Jonah et al.
2021/0010335 A1 * 1/2021 Rus ..... E21B 19/161

FOREIGN PATENT DOCUMENTS

RU 2636334 11/2017
WO 2009/117813 10/2009

OTHER PUBLICATIONS

Notification of Transmittal of the International Search Report and the Written Opinion of the International Search Authority—The Russian Patent Office—dated Oct. 7, 2021 for International Application No. PCT/US21/41612, 6 pages.

* cited by examiner

TUBULAR MAKE-UP AND DELIVERY SYSTEM

RELATED APPLICATIONS

The present application claims benefit of and priority to U.S. Provisional Patent Application No. 63/051,774, filed Jul. 14, 2020, and U.S. Provisional Patent Application No. 63/079,748, filed Sep. 17, 2020, each of which are hereby incorporated by reference for all purposes as if set forth herein in their entireties.

TECHNICAL FIELD

The present disclosure relates generally to oil drilling systems, and more specifically to a tubular makeup and delivery system that can automate the process of assembling drilling equipment.

BACKGROUND OF THE INVENTION

Oil wells require a substantial amount of equipment to build and operate, much of which must be manually assembled. As a result, the cost to build and operate oil wells can be very expensive.

SUMMARY OF THE INVENTION

A system for assembling drilling tubulars is disclosed. The system includes a tiering rack system configured to receive a plurality of sections of drilling tubulars and to selectively provide an individual drilling tubular section. A casing feed and bucking skid system coupled to the tiering rack system is configured to receive the individual drilling tubular section and to combine the individual drilling tubular section with a second individual drilling tubular section. A tubular delivery catwalk system coupled to the casing feed and bucking skid system is configured to receive the combined drilling tubular sections and to transport the combined drilling tubular sections to a drilling rig by elevating on at least two elevating supports.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
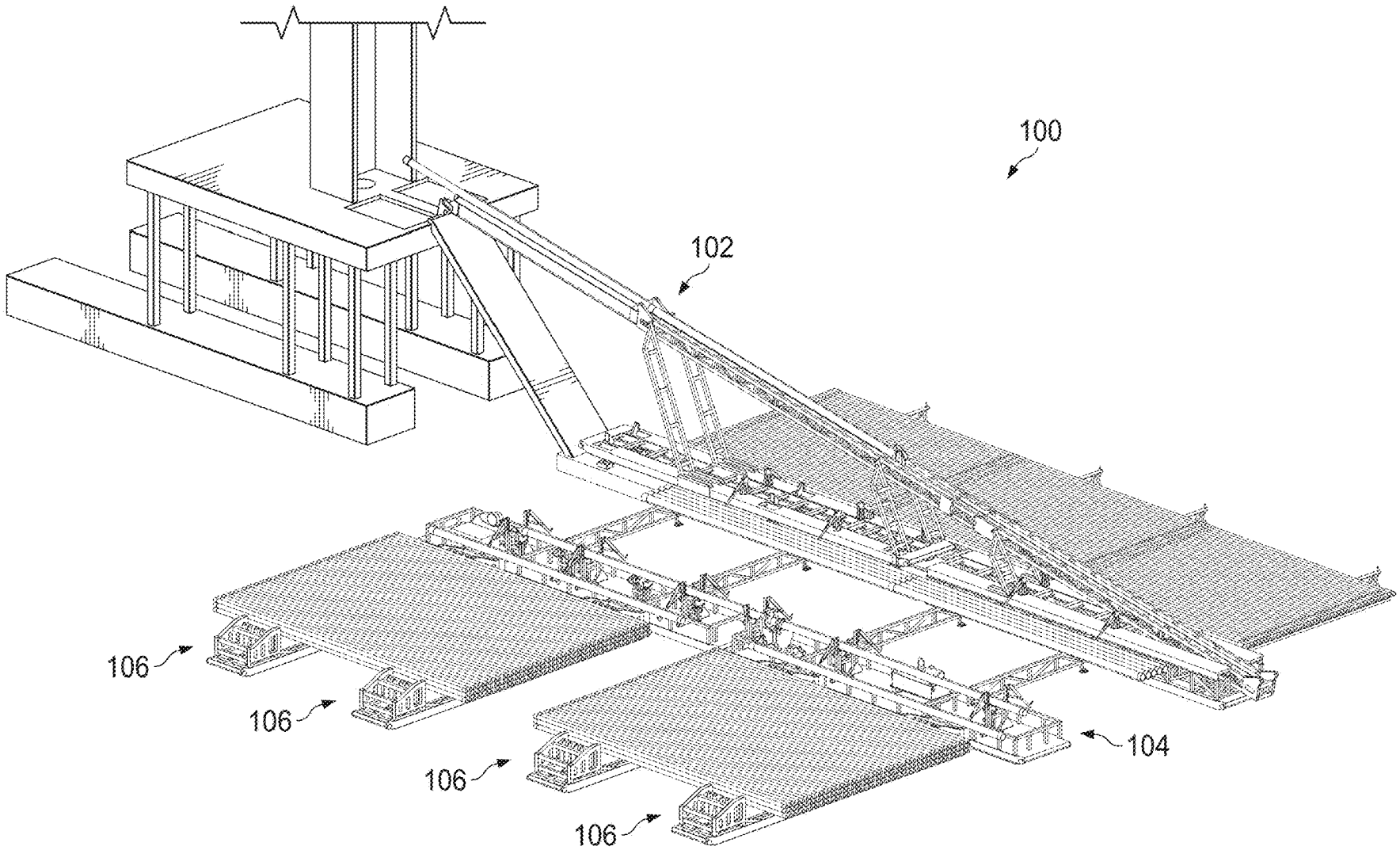
FIG. 1 is a diagram of a system for make-up and delivery of full tubular stands to a rig floor, in accordance with an example embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

In the oil and gas industry, mechanized or automated functions of drilling rigs can be provided to reduce the amount of manual labor and hazards associated with setting up and operating the drilling rigs. For example, a power catwalk can be used to facilitate safe and efficient movement of a tubular (such as drill pipe and casing) to the rig floor, where it is deployed into service downhole.

Power catwalks can be used to deliver Range 3 (45 ft. long) tubulars to the rig floor as single joints, and are primarily used to handle drill pipe. The present disclosure provides systems and methods to make-up and deliver full stands of casing to the rig floor (such as 2×45 ft. joints, or a single 90 ft. stand). By delivering full stands to the rig floor, connection time and casing running times can be reduced, which improves the run rate and allows an operator to save a significant amount of money over the course of the well.

FIG. 1 is a diagram of a system 100 for make-up and delivery of full tubular stands to a rig floor, in accordance with an example embodiment of the present disclosure. System 100 includes tubular delivery catwalk 102, casing feed and bucking skid 104 and tiering racks 106, each of which can be fabricated from steel, iron, carbon steel, other suitable metals, other suitable materials or a suitable combination of materials, from hydraulic components, electrical controls and other suitable materials as discussed and described herein.

Tubular delivery catwalk 102 can be constructed from steel components and includes hydraulic or other suitable actuators that lift a trough that holds a casing or pipe assembly that has been assembled from casing or pipe components. Likewise, other suitable components can be assembled using tubular delivery catwalk 102. Tubular delivery catwalk 102 can operate under algorithmic control using one or more processors, or in combination with one or more manual actuators, as discussed further herein.

Casing feed and bucking skid 104 can be constructed from steel components and includes hydraulic or other suitable actuators that lift casing or pipe components to allow them to be assembled into a casing or pipe assembly, or other suitable components. In one example embodiment, casing feed and bucking skid 104 can be separated into a separate casing feed component and bucking skid component that are independently operated under algorithmic control using one or more processors, or in combination with one or more manual actuators, as discussed further herein.

Tiering racks 106 can be constructed from steel components and includes hydraulic or other suitable actuators that lift casing or pipe components to allow them to be assembled into a casing or pipe assembly, or other suitable components. In one example embodiment, tiering racks 106 can be independently operated under algorithmic control using one or more processors, or in combination with one or more manual actuators, as discussed further herein.

Figure 2:
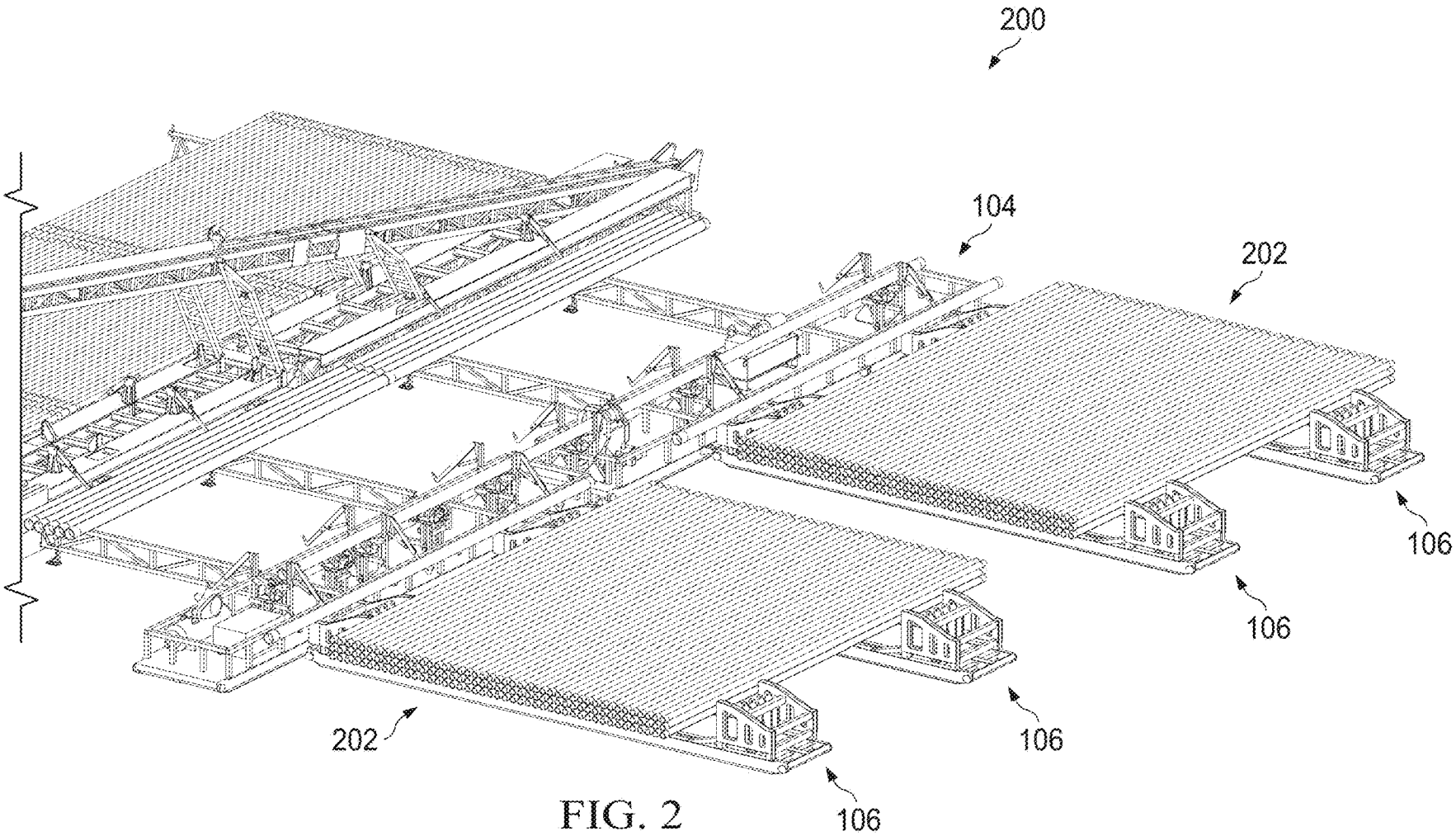
FIG. 2 is a diagram of a system for movement of individual pipe or casing joints, in accordance with an example embodiment of the present disclosure.

FIG. 2 is a diagram of a system 200 for movement of individual pipe or casing joints, in accordance with an example embodiment of the present disclosure. In one example embodiment, a drilling rig can be installed onto location and drilling can be commenced. Typically, the rig is owned and operated by an independent company. Tubular delivery catwalk 102, casing feed and bucking skid 104 and tiering racks 106 are then installed at the location, such as shown above.

While the rig is drilling, casing joints 202 (which are typically 40 to 45 ft. lengths) are loaded onto the tiering racks 106 with use of an on-site loader. Tiering racks 106 can hold multiple joints of casing and can be tiered or stacked to accommodate the joints of casing required to case the well section. Drilling pipe or other suitable materials can also or alternatively be handled by system 200.

Figure 3:
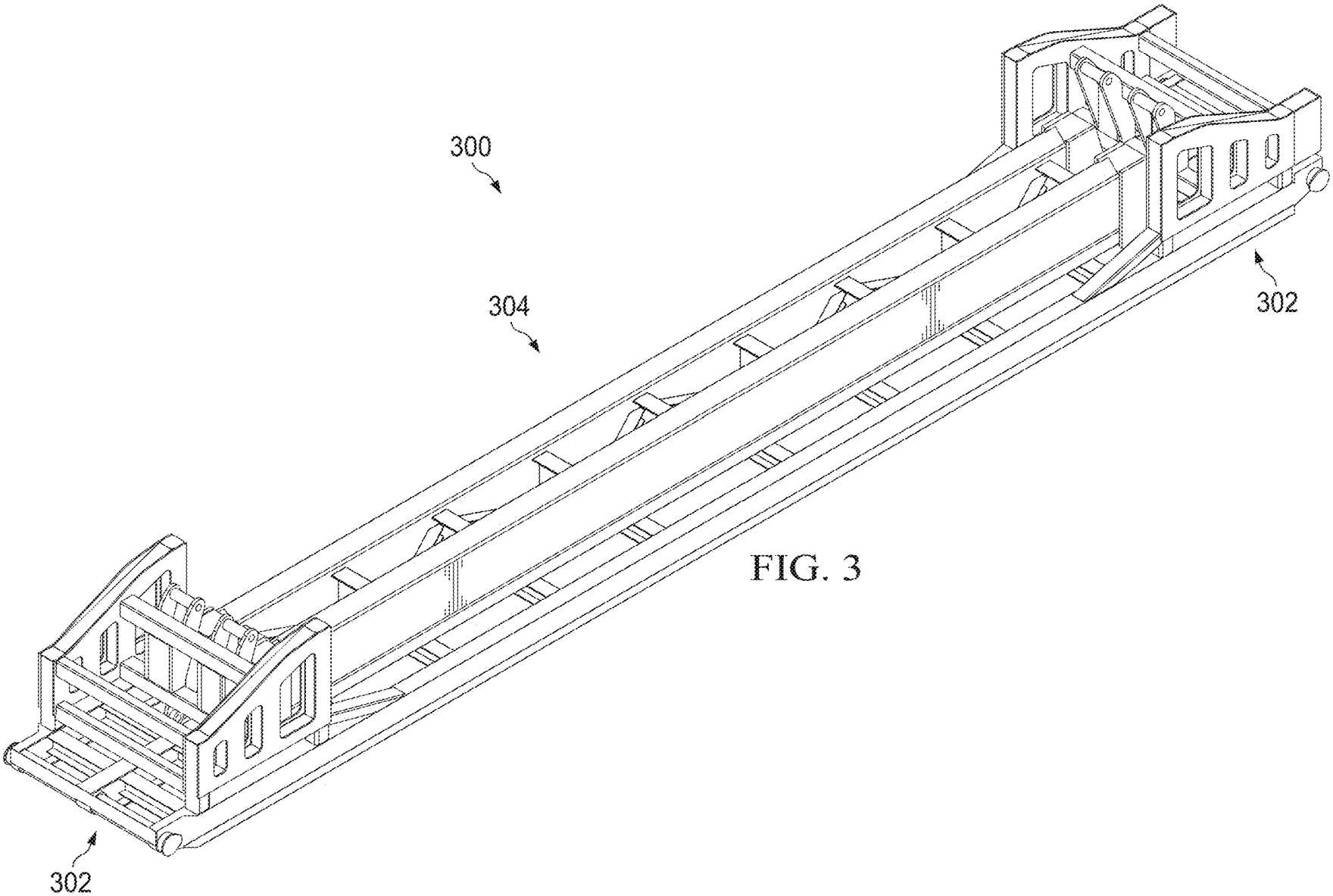
FIG. 3 is a diagram of a system for loading pipe or casing joint sections, in accordance with an example embodiment of the present disclosure.

FIG. 3 is a diagram of a system 300 for loading pipe or casing joint sections, in accordance with an example embodiment of the present disclosure. In one example embodiment, once the casing or pipe sections have been loaded onto support 304 of tiering racks 106, independent hydraulic cylinders 302, located on each end of tiering racks 106, can be activated by receiving a control signal from a controller operating under algorithmic control, such as in response to one or more sensor inputs. In another example embodiment, a manual control can be used to actuate the operation of hydraulic cylinders 302, or other suitable processes can also or alternatively be used.

Figure 4:
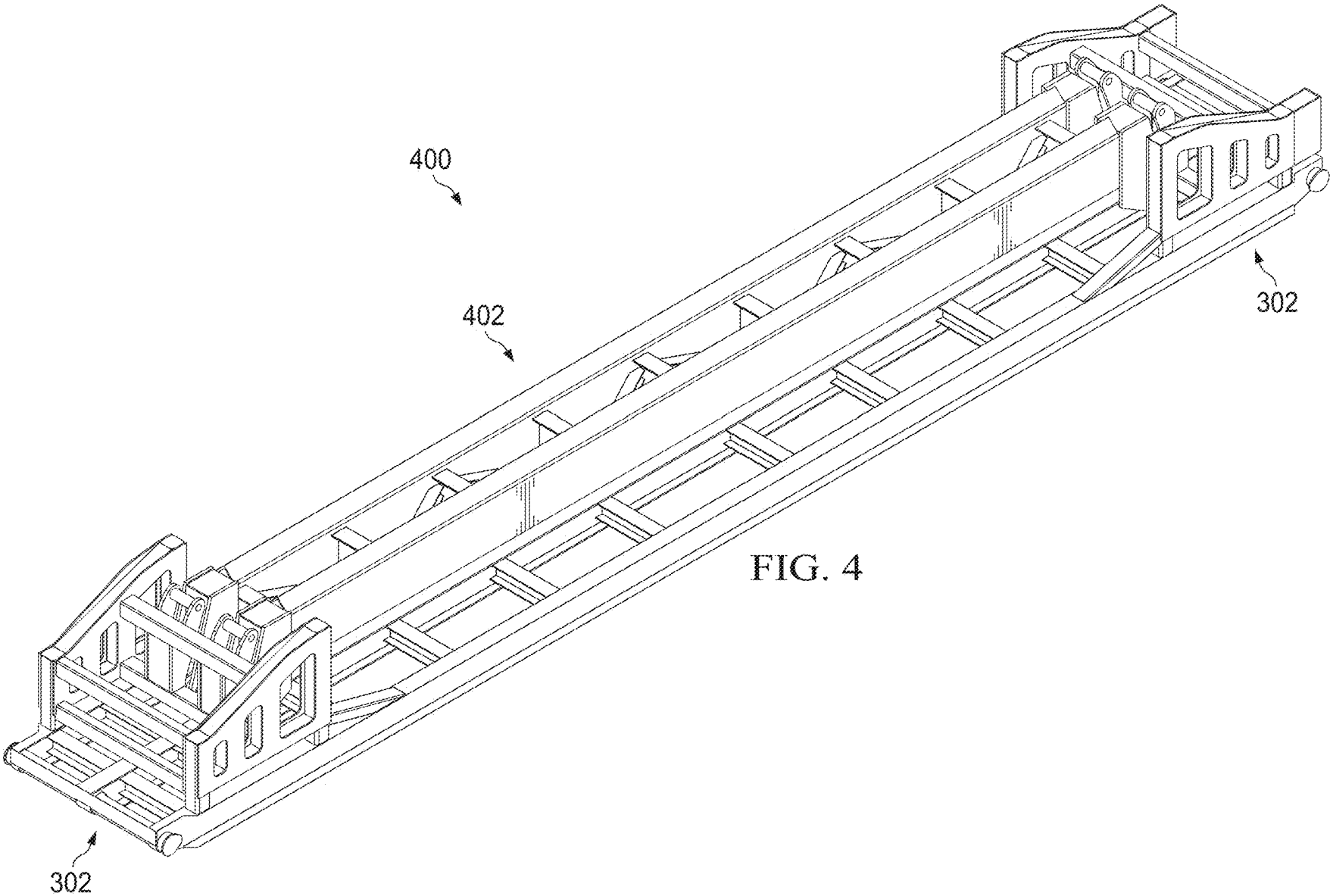
FIG. 4 is a diagram of a system for loading pipe or casing joint sections, in accordance with an example embodiment of the present disclosure.

FIG. 4 is a diagram of a system 400 for loading pipe or casing joint sections, in accordance with an example embodiment of the present disclosure. Support 402 holds the casing or pipe sections and elevates them above the side wall of support 402, which allows the top tier to roll onto an adjacent loading area of casing feed and bucking skid 104. Once the top tier is rolled onto the loading area of casing feed and bucking skid 104, the loading arms on the casing feed/bucking skid 104 can be used to load one casing/pipe section, or "joint," at a time into the casing feed and bucking skid 104.

Figure 5:
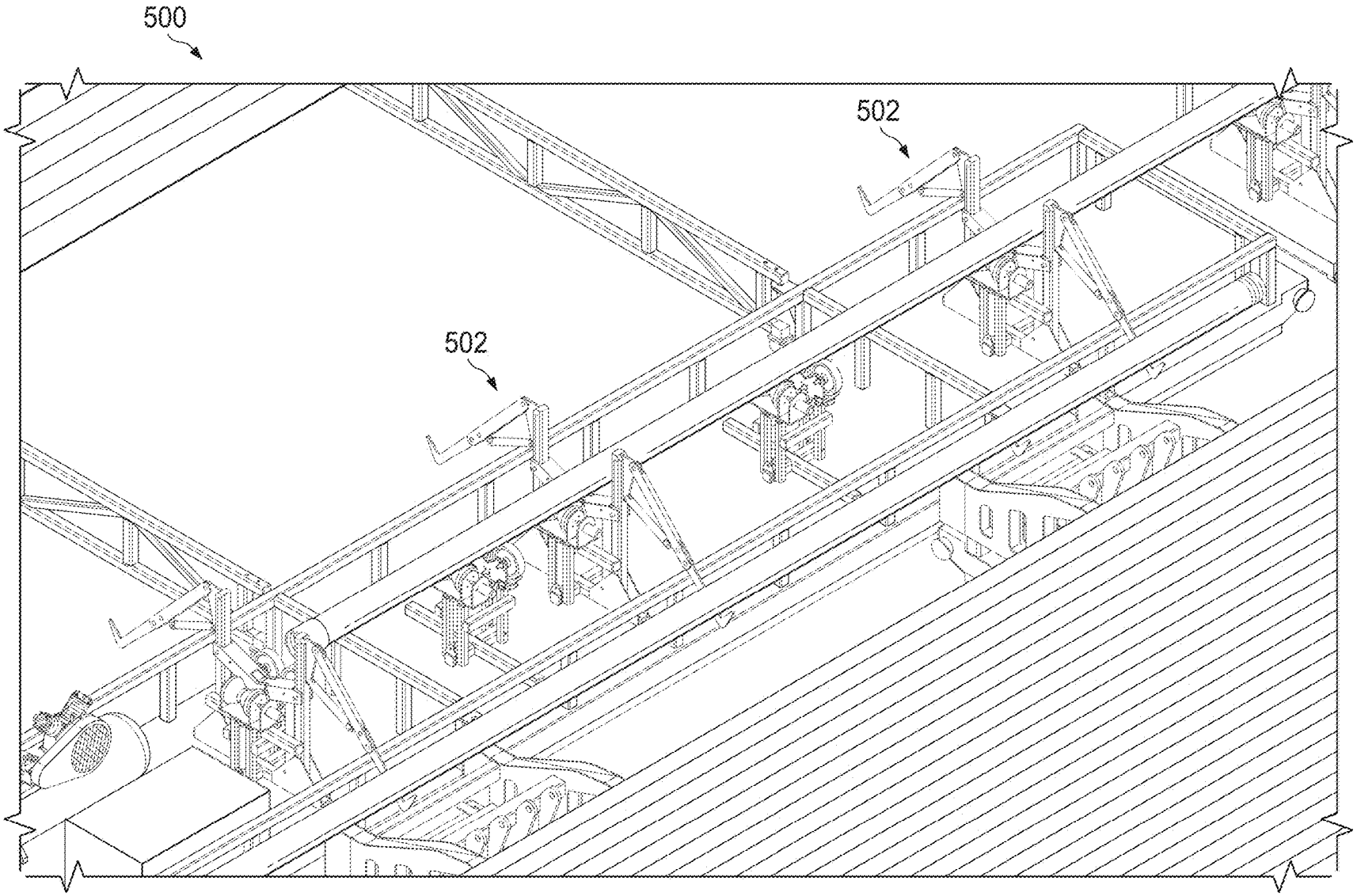
FIG. 5 is a diagram of a system for elevating pipe or casing joint sections, in accordance with an example embodiment of the present disclosure.

FIG. 5 is a diagram of a system 500 for elevating pipe or casing joint sections, in accordance with an example embodiment of the present disclosure. Once the casing or pipe section is at the loading area of casing feed and bucking skid 104, loading arms 502 are actuated in unison to elevated the casing or pipe section and to translocate the casing or pipe section to the center of the skid frame. Loading arms 502 can be separately controlled using a programmable controller, manual controls, a combination of controls or in other suitable manners, and can use hydraulic power, electric power or other suitable power sources to operate. In one example embodiment, loading arms 502 can include robotic controls, can have one or more predetermined movement functions (e.g. a first movement function to move a pipe from a loading position to a fabrication position and a second movement function to return to the loading position after the pipe has been fabricated), or other suitable controls. The loading arms 502 are actuated to lower the casing or pipe section onto the frame of the casing feed and bucking skid 104 at a desired elevation, such as by operating loading arms 502 under algorithmic control, and in response to one or more sensors that are activated when the casing or pipe section has reached a predetermined location. In another example embodiment, one or more manual controls can be activated once the casing or pipe section has reached a predetermined location, or other suitable processes can also or alternatively be used.

Figure 6:
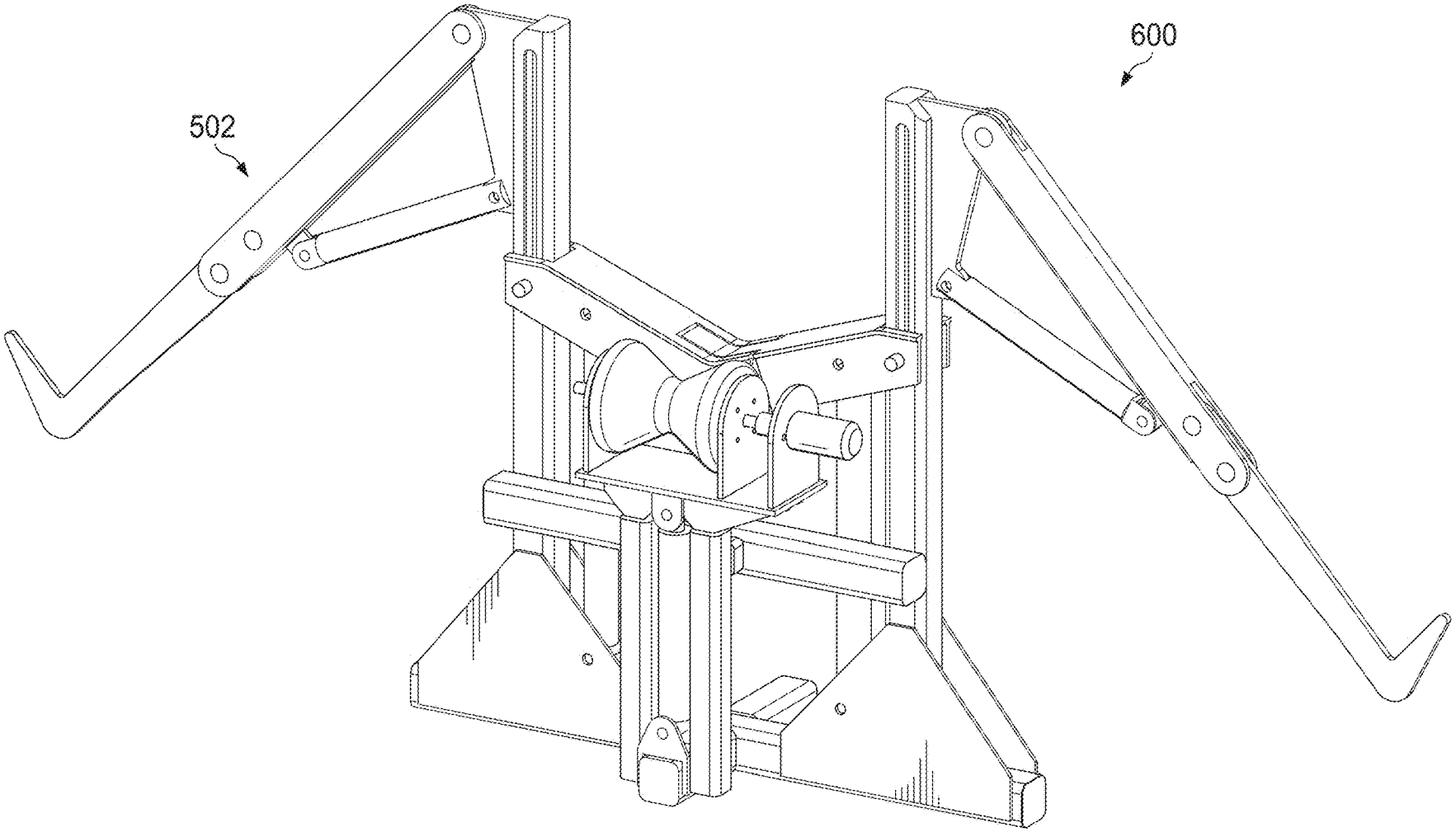
FIG. 6 is a diagram of a system for elevating individual pipe or casing sections, in accordance with an example embodiment of the present disclosure.

FIG. 6 is a diagram of a system 600 for elevating individual pipe or casing sections, in accordance with an example embodiment of the present disclosure. System 600 shows a loading arm 502 in a retracted configuration, which can be one of two or more positions that are selected under algorithmic control, in response to a user-activated manual control or in other suitable manners.

Figure 7:
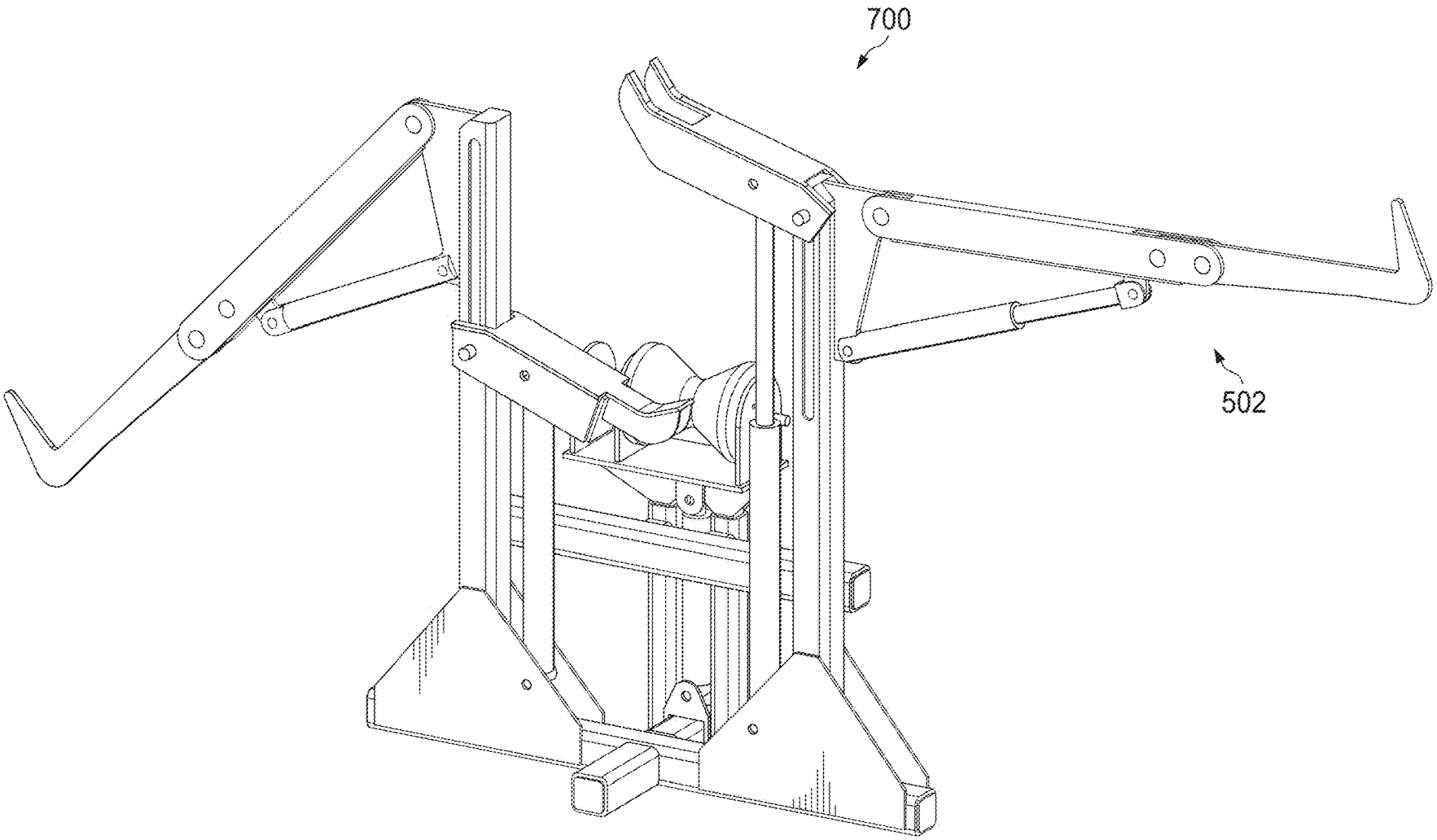
FIG. 7 is a diagram of a system for movement of individual pipe or casing joints, in accordance with an example embodiment of the present disclosure.

FIG. 7 is a diagram of a system 700 for movement of individual pipe or casing joints, in accordance with an example embodiment of the present disclosure. System 700 shows a loading arm 502 in an extended configuration, which can be one of two or more positions that are selected under algorithmic control, in response to a user-activated manual control or in other suitable manners.

Figure 8:
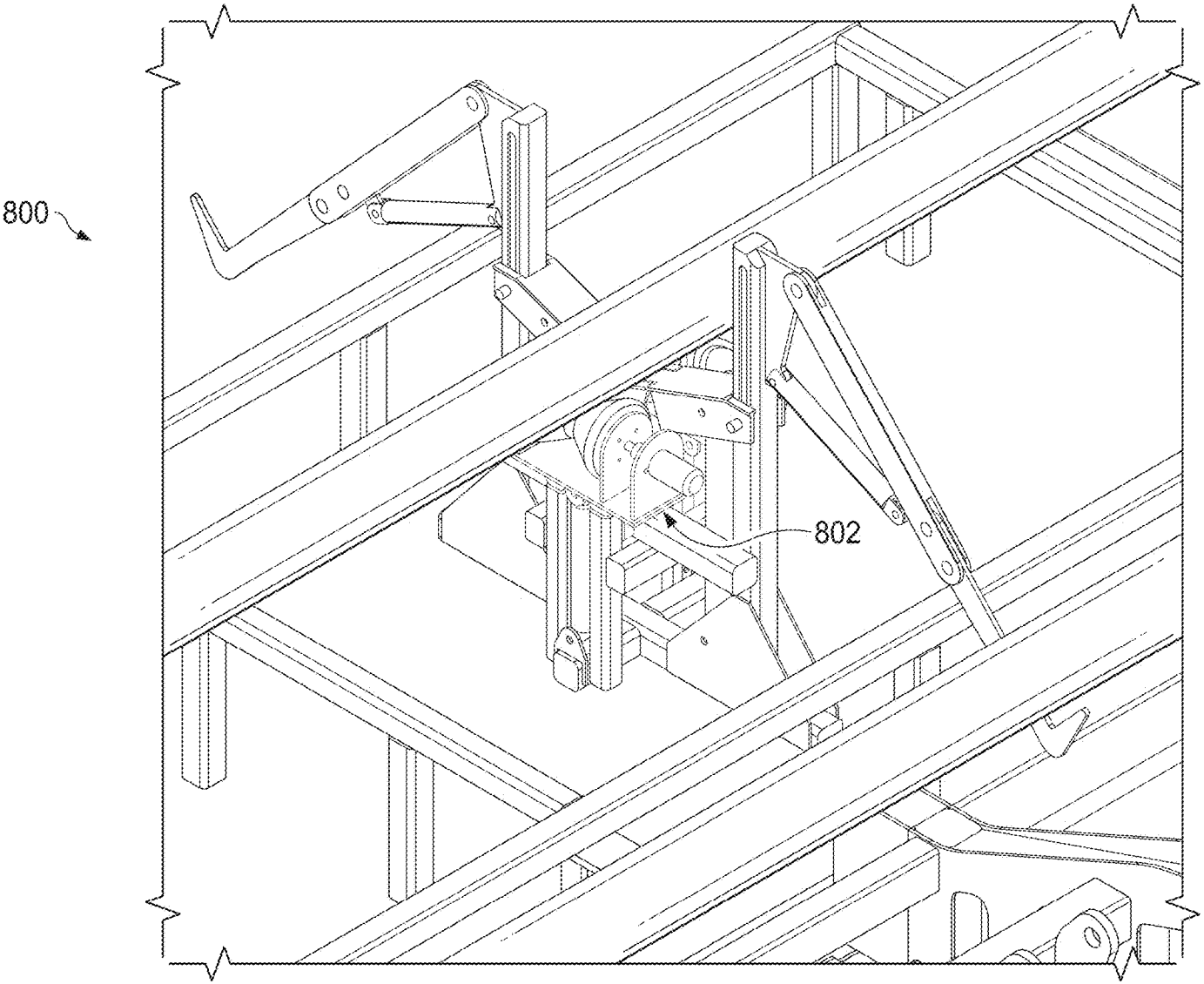
FIG. 8 is a diagram of a system for rolling individual pipe or casing sections, in accordance with an example embodiment of the present disclosure.

FIG. 8 is a diagram of a system 800 for rolling individual pipe or casing sections, in accordance with an example embodiment of the present disclosure. A series of pipe rollers 802 are controlled to rotate in unison which once the pipe or casing joint is lowered into position and resting, such as by using one or more sensors, one or more manually activated controls or in other suitable manners. The pipe rollers 802 push the joint of pipe or casing forward or backwards, such as in response to position sensors, manual controls or in other suitable manners. The pipe rollers 802 can be driven hydraulically, using a DC step motor or using other suitable devices that allow controllable pipe movement, and can be raised or lowered where suitable to control the elevation of the pipe or casing joint, such as with use of a hydraulic cylinder or other suitable devices and one or more algorithmic controls, manual controls or in other suitable manners.

Figure 9:
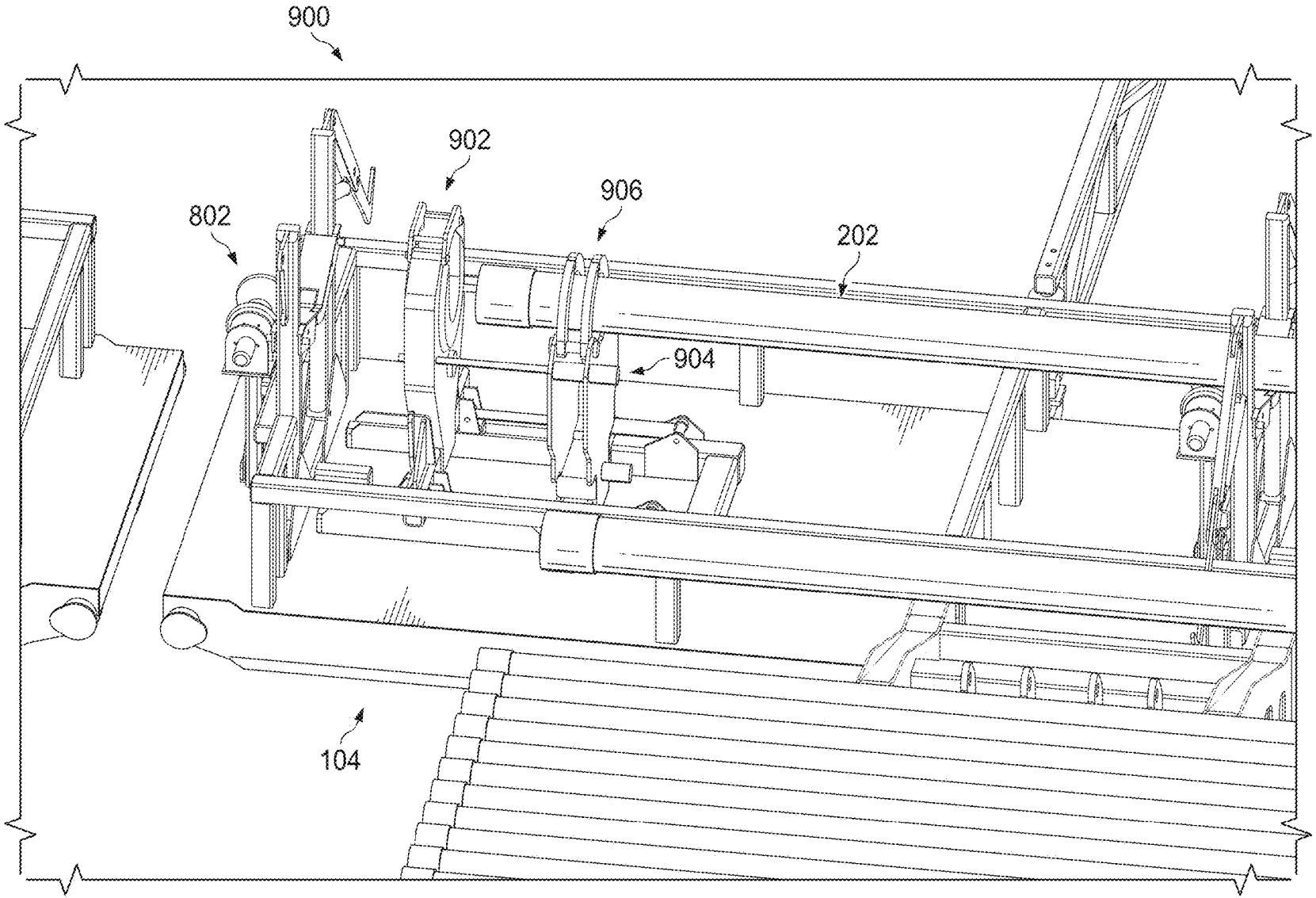
FIG. 9 is a diagram of a system for assembly of pipe or casing sections, in accordance with an example embodiment of the present disclosure.

FIG. 9 is a diagram of a system 900 for assembly of pipe or casing sections, in accordance with an example embodiment of the present disclosure. Once the joint of pipe or casing 202 is located at a suitable location, such as in the center of the feed skid, the pipe rollers 802 can be activated to push the pipe or casing joint forward onto the bucking skid portion of casing feed and bucking skid 104. The pipe or casing 202 can be maneuvered to clear the make-up jaw 902 on the power tong 904, but not the backup tong jaw 906, such as by using one or more algorithmic processes operating on a process control processor, using one or more manual activators or in other suitable manners. The back-up tong jaw 906 can engage and grip the joint of pipe or casing using hydraulic power, a DC stepper motor or other suitable drives. The power tong 904 can be selected to handle the size of the pipe or casing, can be automatically adjustable, can include selectable jaws or can be configured in other suitable manners.

Figure 10:
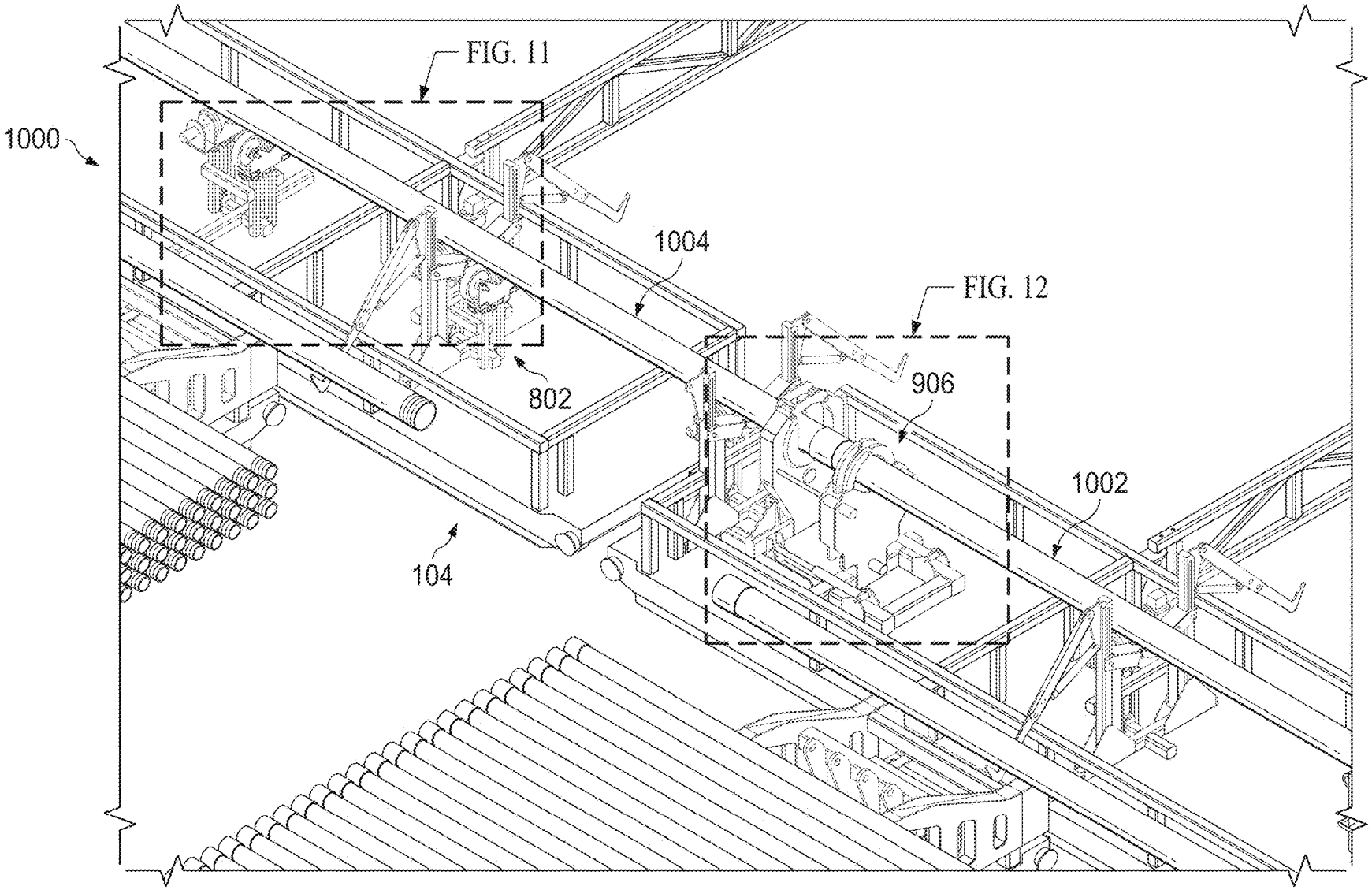
FIGS. 10 and 11 are diagrams of a system for assembly of pipe or casing sections, in accordance with an example embodiment of the present disclosure.
Figure 11:
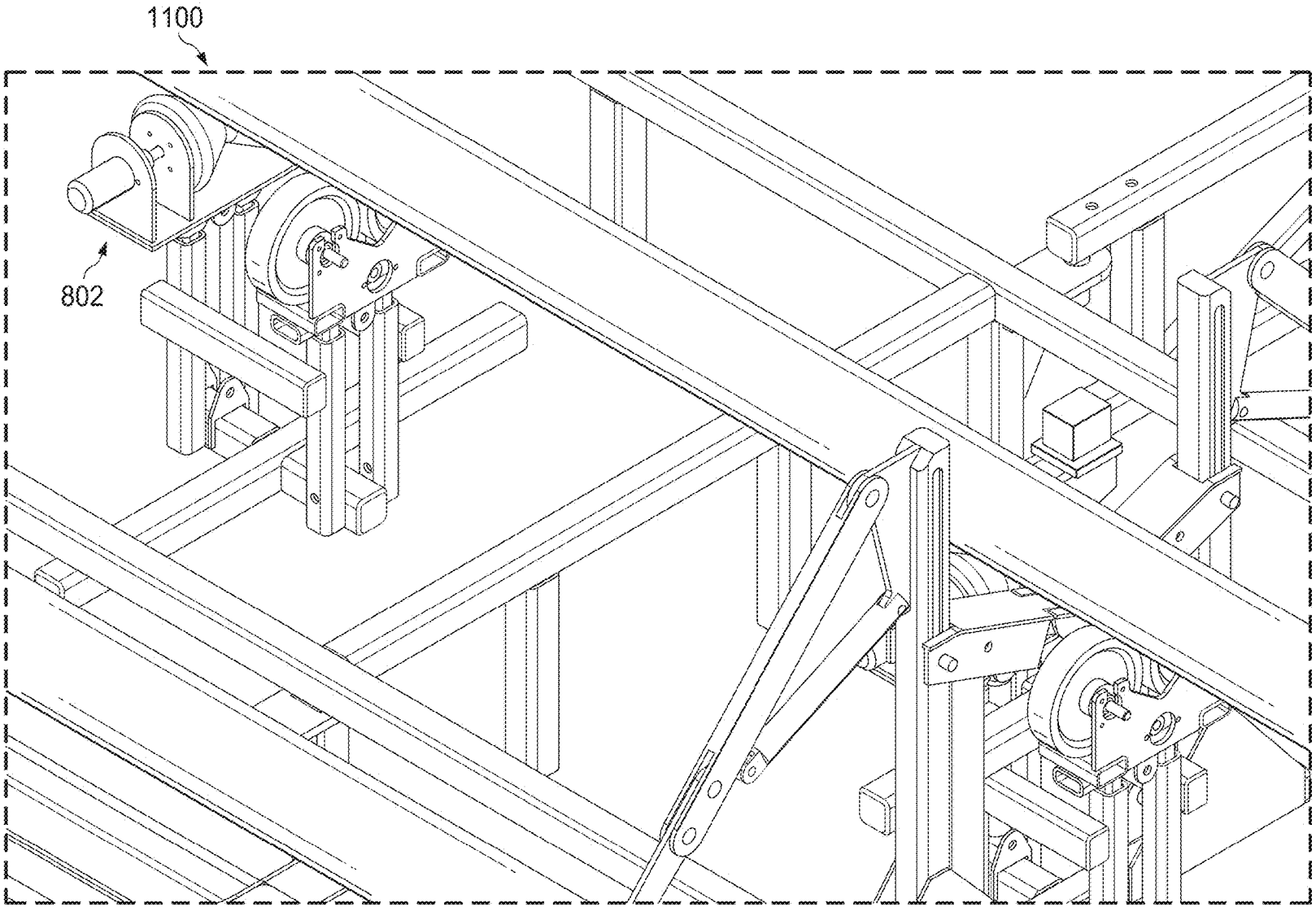

FIGS. 10 and 11 are diagrams of a system 1000 and 1100, respectively, for assembly of pipe or casing sections, in accordance with an example embodiment of the present disclosure. Once the first joint of pipe or casing 1002 is gripped by backup tong jaw 906, the second joint of pipe or casing 1004 is loaded onto the feed skid 104 using the process discussed above or other suitable processes. After the second pipe or casing joint 1004 is sitting on the pipe rollers 802, the pipe rollers are energized, such as under control of one or more processors operating under algorithmic control, in response to one or more manual controls or in other suitable manners. While the first joint of casing 1002 is restrained by the backup tong 906, the second joint of casing 1004 is pushed into the first casing joint 1002. Pipe spinners are then raised into position, to take weight off the pipe rollers 802 and to spin the second pipe or casing joint 1004 into the first pipe or casing joint 1002, thus coupling the two joints together. The joints can be spun to engage with the threads and seal, but without applying a substantial amount of torque.

Figure 12:
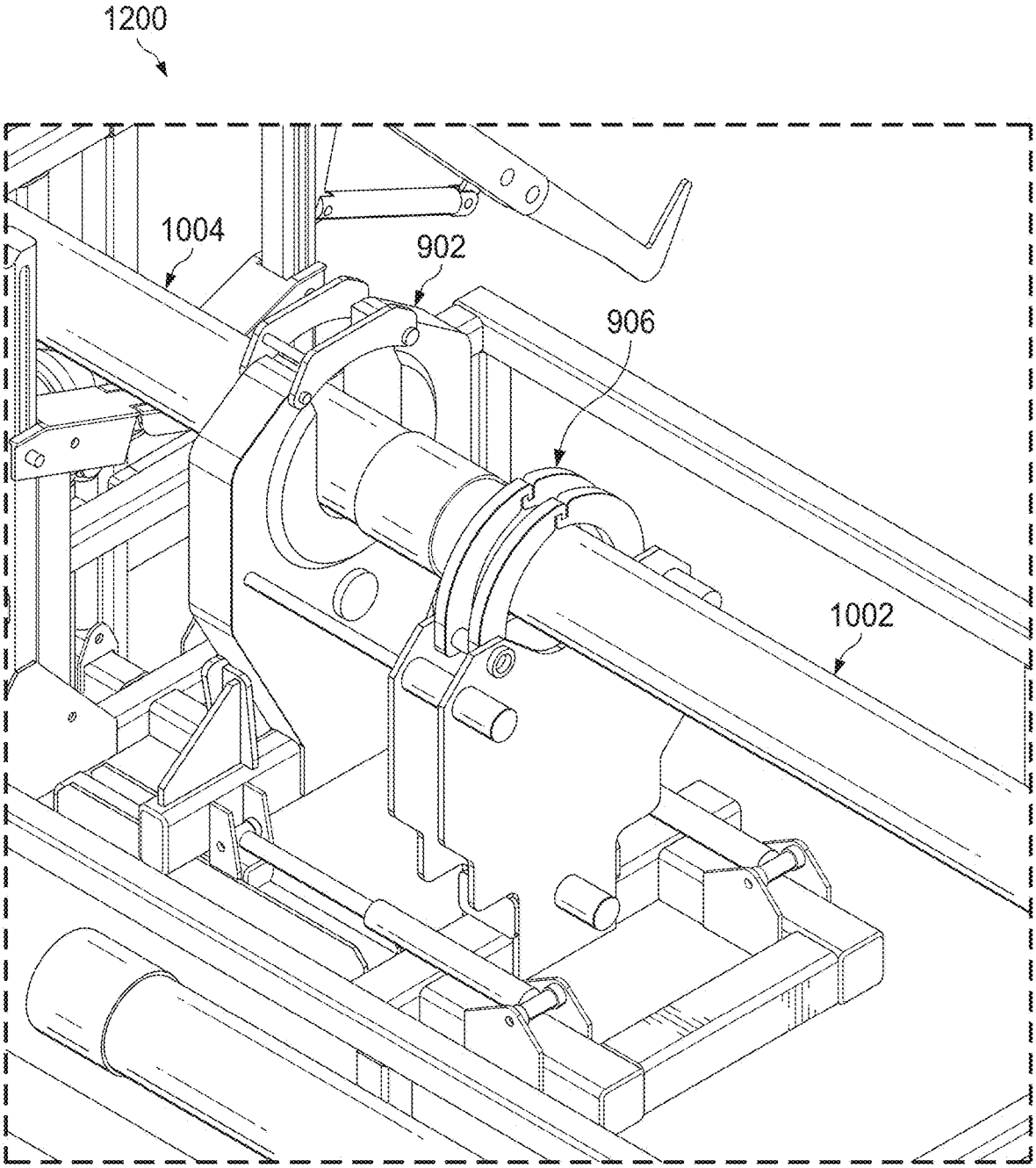
FIG. 12 is a diagram of a system for assembly of pipe or casing sections, in accordance with an example embodiment of the present disclosure.

FIG. 12 is a diagram of a system 1200 for assembly of pipe or casing sections, in accordance with an example embodiment of the present disclosure. Once the two joints are spun together, the make-up tong 902 grips the second joint of casing 1004 and the connection is then torqued to the required specification, such as in response to one or more sensor inputs, one or more manual controls or in other suitable manners. Once torqued, the make-up tong 902 and back-up tong 906 are released, and jaws opened up to allow the made-up pipe or casing joint be raised and removed from the casing feed and bucking skid 104. The casing joint can then be removed from the center frame using the steps described above, using the other side of the system or in other suitable manners. The made-up joint of casing can then lowered and installed on adjacent racks, where it is ready for installation onto the delivery catwalk 102.

Figure 13:
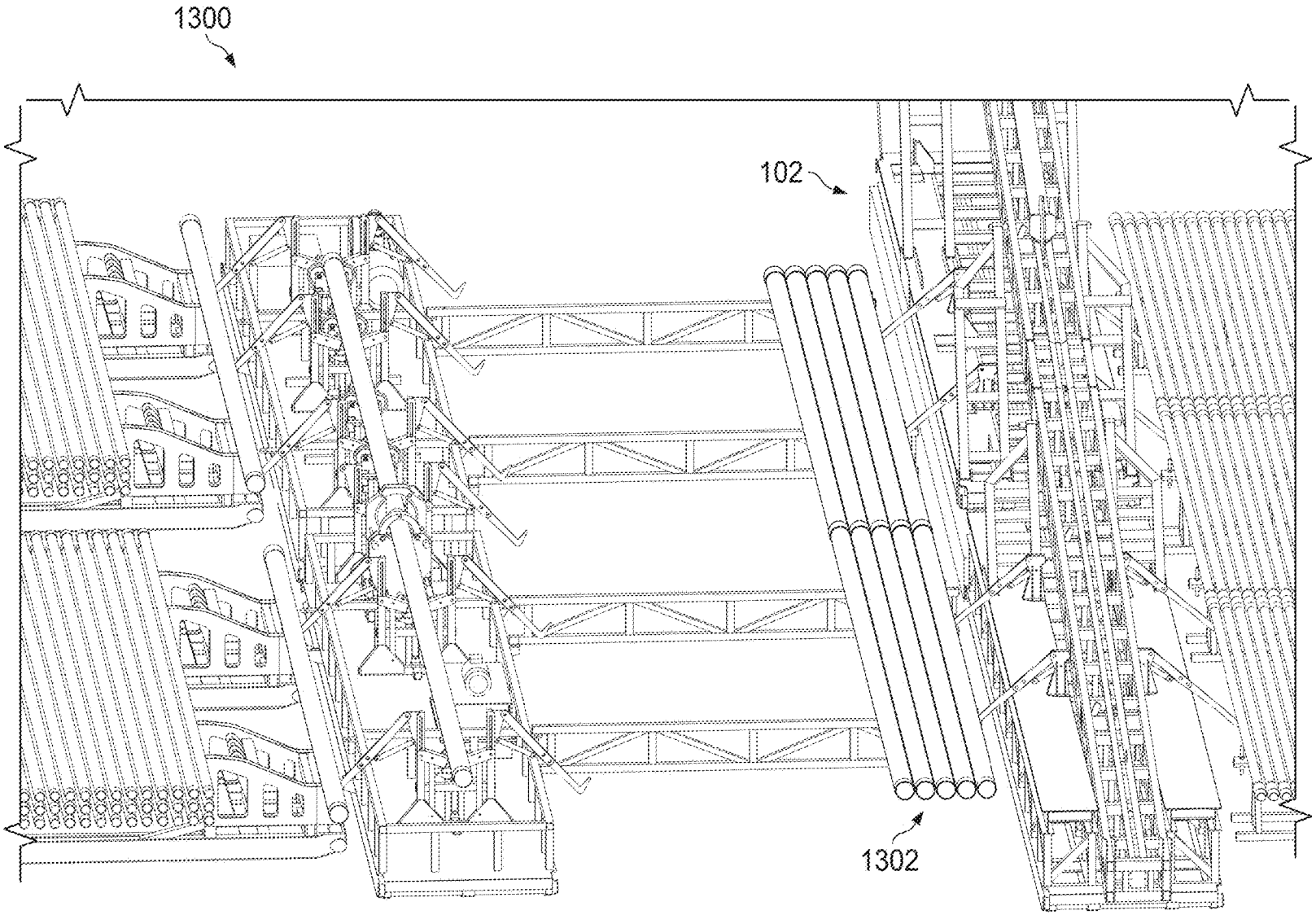
FIG. 13 is a diagram of a system for transfer of pipe or casing joint assemblies, in accordance with an example embodiment of the present disclosure.

FIG. 13 is a diagram of a system 1300 for transfer of pipe or casing joint assemblies, in accordance with an example embodiment of the present disclosure. The casing delivery catwalk 102 can be controlled in unison with the rig's substructure, mast and top drive, in order to accommodate the made-up assembly of pipe or casing 1302, which can be roughly 90 ft. long or other suitable lengths. Conventional catwalks can only accommodate 45 ft. lengths. The delivery catwalk 102 shown can be shipped as two separate loads, however these loads can be combined as one load to make transport and set-up easier.

Figure 14:
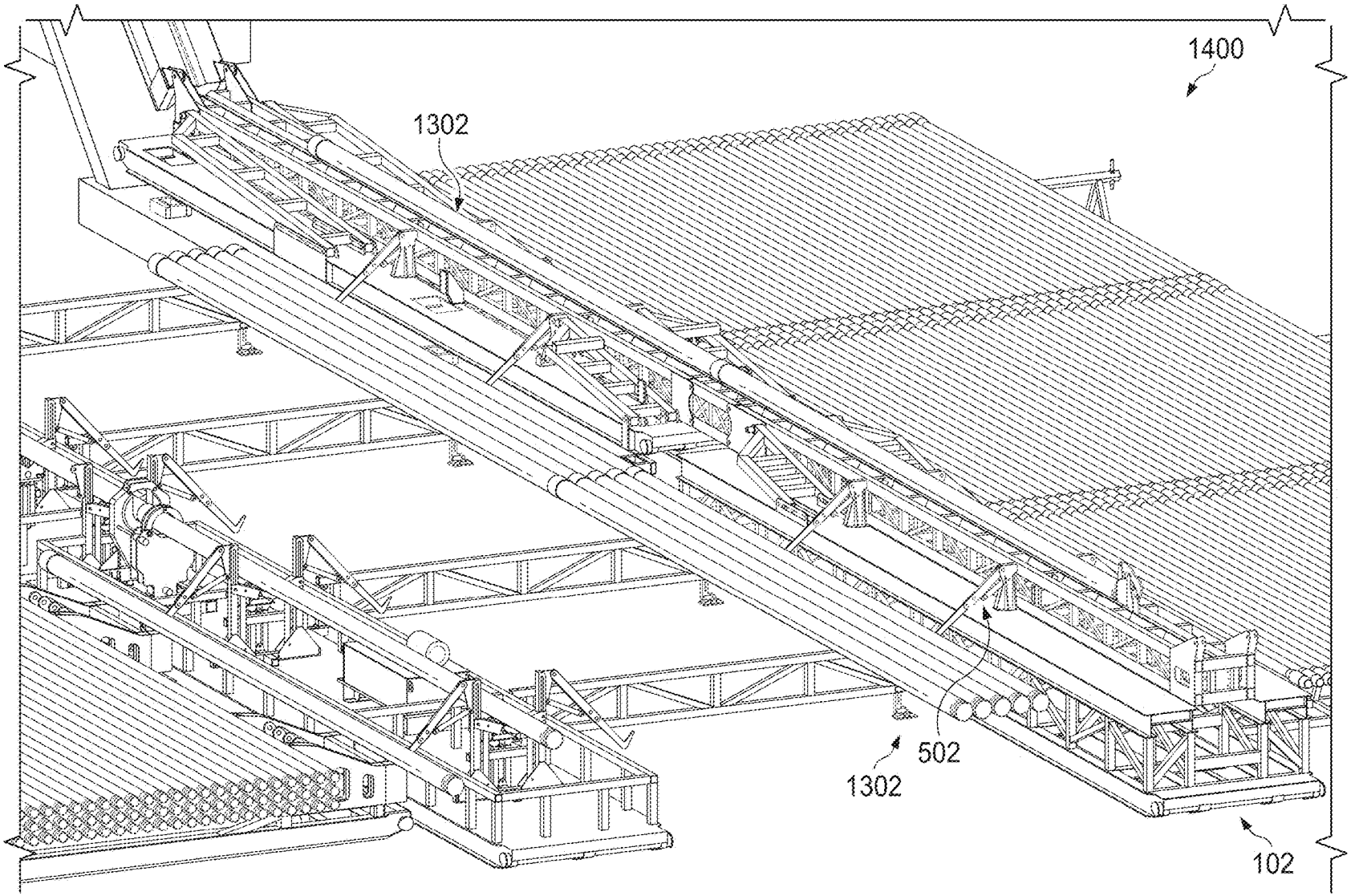
FIG. 14 is a diagram of a system for movement of pipe or casing joint assemblies, in accordance with an example embodiment of the present disclosure.

FIG. 14 is a diagram of a system 1400 for movement of pipe or casing joint assemblies, in accordance with an example embodiment of the present disclosure. Once the made-up pipe or casing assembly 1302 is in position, the delivery catwalk 102 can be controlled by one or more processors operating under algorithmic control, one or more manual controls or in other suitable manners to raise the pipe or casing assembly 1302, such as using loading arms 502 or in other suitable manners. The pipe or casing assembly 1302 can be rolled into the center trough on the delivery catwalk 102 or moved in other suitable manners.

Figure 15:
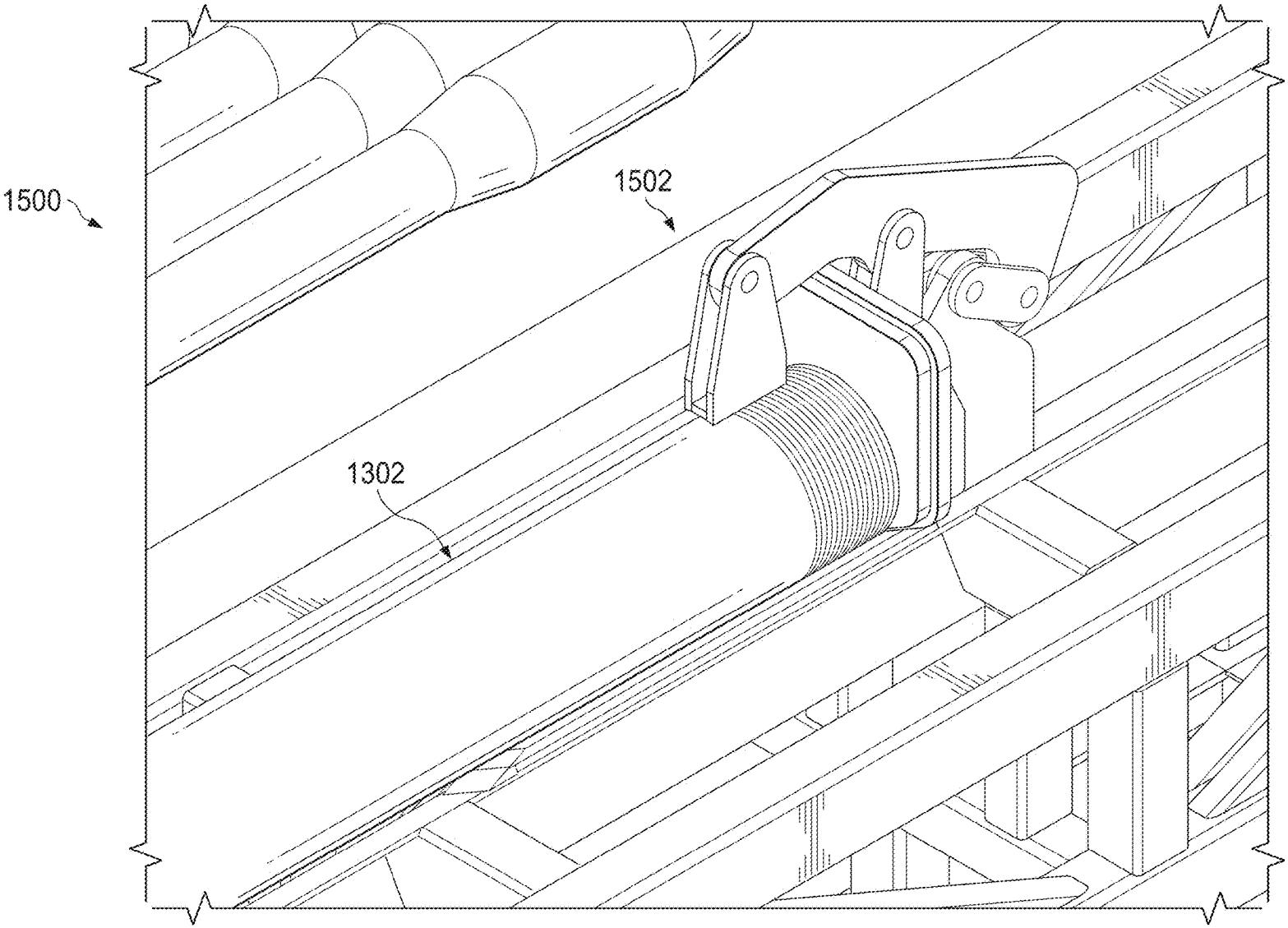
FIG. 15 is a diagram of a system for movement of pipe or casing joint assemblies, in accordance with an example embodiment of the present disclosure.

FIG. 15 is a diagram of a system 1500 for movement of pipe or casing joint assemblies, in accordance with an example embodiment of the present disclosure. Once in position, the skate 1502 can be brought forward and engaged with the pipe or casing assembly 1302, such as by a processor operating under algorithmic control and in response to one or more sensor inputs, in response to one or more manually activated controls or in other suitable manners, to cause the pipe or casing assembly 1302 to touch the face of skate 1502.

Figure 16:
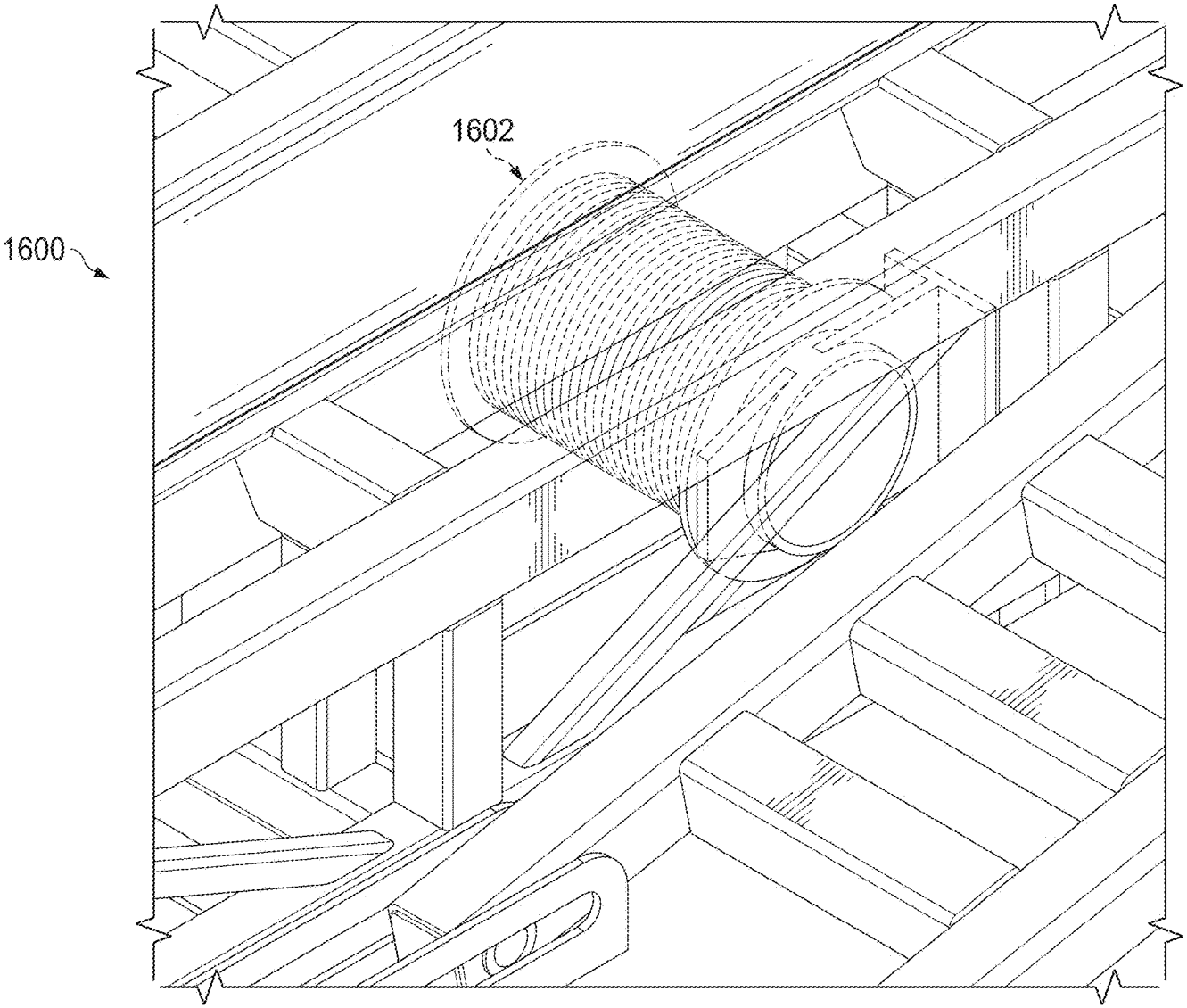
FIG. 16 is a diagram of a system for movement of pipe or casing joint assemblies, in accordance with an example embodiment of the present disclosure.

FIG. 16 is a diagram of a system 1600 for movement of pipe or casing joint assemblies, in accordance with an example embodiment of the present disclosure. The skate 1502 can be driven using a hydraulically drum 1602 located in the trough center, a DC stepper motor or other suitable devices. The skate 1502 can be driven forward or backwards, as needed, to allow the pipe or casing assembly 1302 to be moved, using one or more processors operating under algorithmic control, one or more manually activated controls or in other suitable manners.

Figure 17:
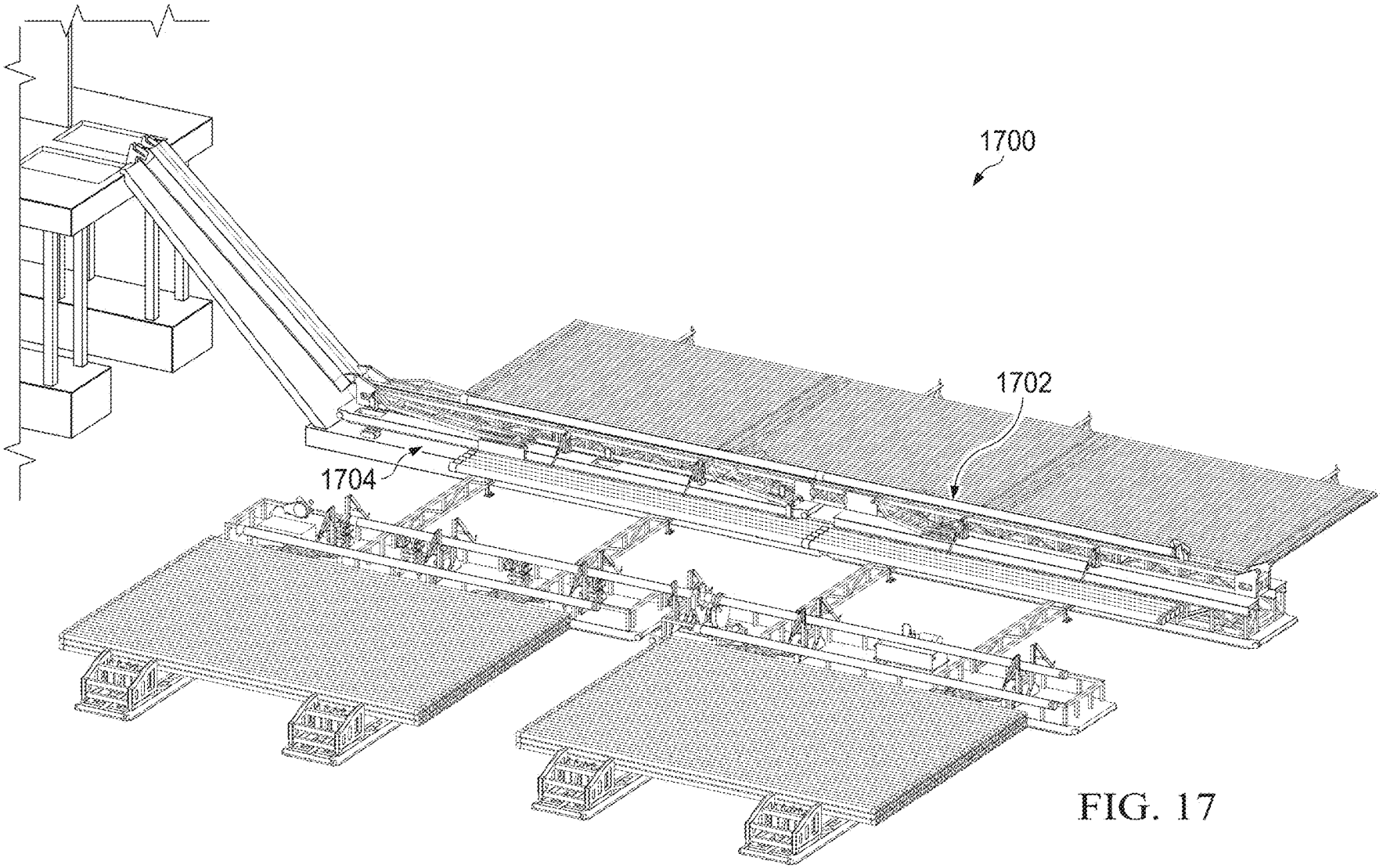
FIG. 17 is a diagram of a system for movement of pipe or casing joint assemblies, in accordance with an example embodiment of the present disclosure.

FIG. 17 is a diagram of a system 1700 for movement of pipe or casing joint assemblies, in accordance with an example embodiment of the present disclosure. The catwalk trough 1702 can then elevated hydraulically using a set of cylinders 1704 or in other suitable manners. As the catwalk trough 1702 is raised, a v-shaped door which is attached to the front of the catwalk trough 1702 an be pivoted or raised until the v-shaped door and trough are parallel with each other.

Figure 18:
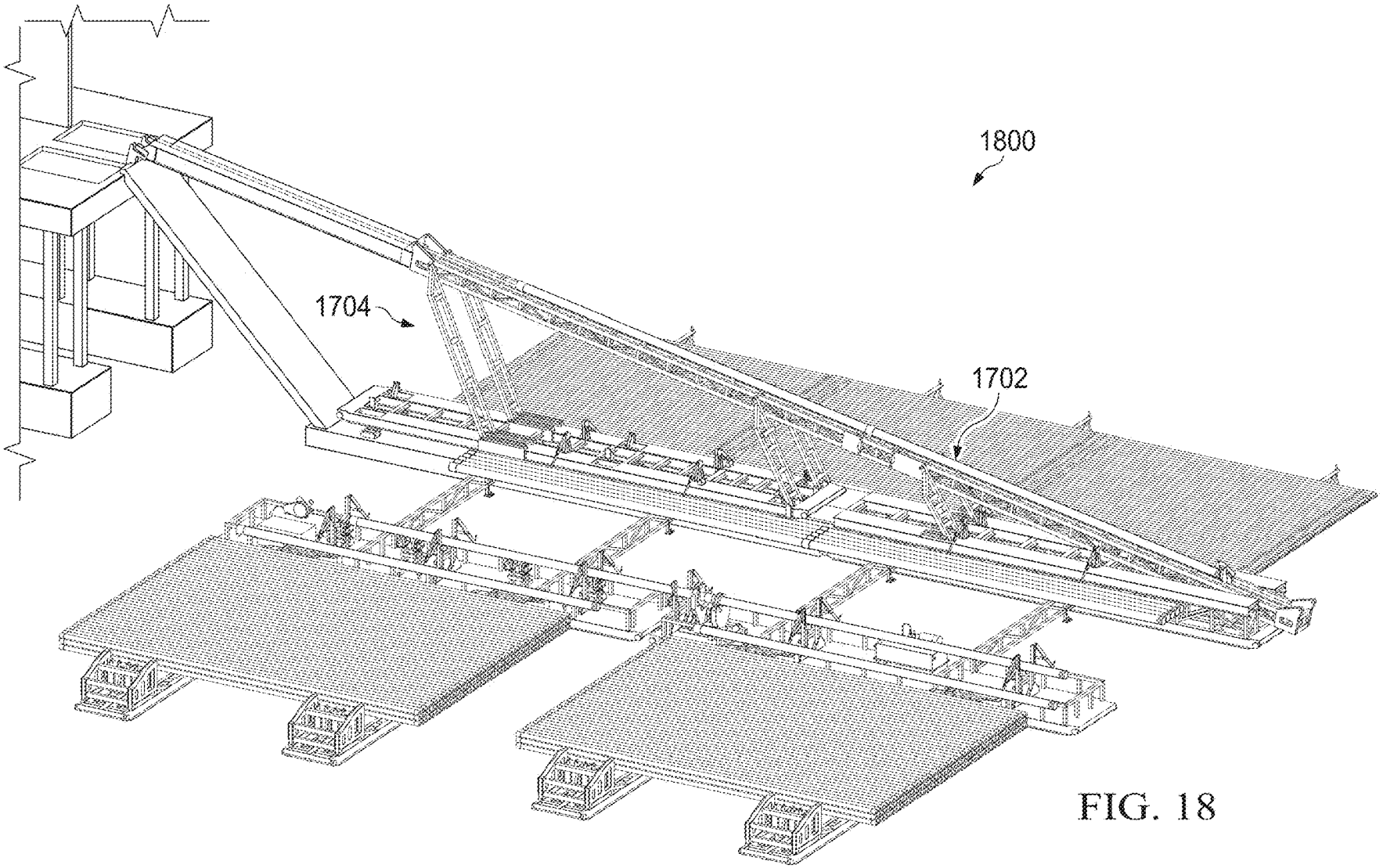
FIG. 18 is a diagram of a system for movement of pipe or casing joint assemblies, in accordance with an example embodiment of the present disclosure.

FIG. 18 is a diagram of a system 1800 for movement of pipe or casing joint assemblies, in accordance with an example embodiment of the present disclosure. Once the catwalk trough 1702 and v-door are parallel, they are at the optimal angle where the pipe or casing assembly 1302 can be pushed towards the rig floor, where the top drive can latch onto the pipe or casing assembly 1302 and lower it onto the wellbore.

Figure 19:
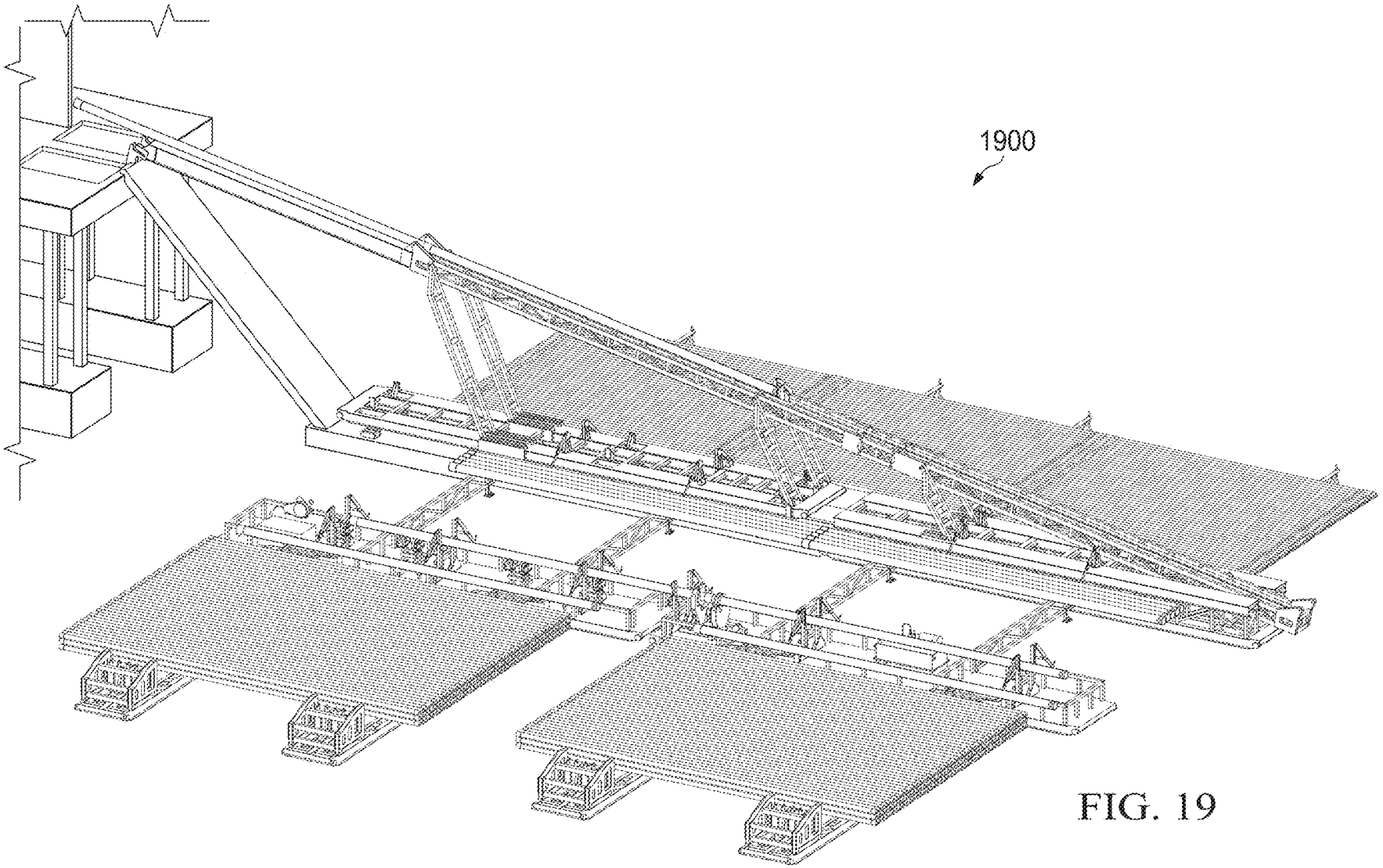
FIG. 19 is a diagram of a system for movement of pipe or casing joint assemblies, in accordance with an example embodiment of the present disclosure.

FIG. 19 is a diagram of a system 1900 for movement of pipe or casing joint assemblies, in accordance with an example embodiment of the present disclosure. Once elevated, the skate 1502 pushes the pipe or casing assembly 1302 towards the well center, and the top drive latches onto the pipe or casing assembly 1302 with its elevators. The pipe or casing assembly 1302 is then raised up the mast with the bottom of the pipe or casing assembly 1302 sliding on the catwalk trough 1702. The pipe or casing assembly 1302 is then elevated to a point where the rig personnel can guide the casing towards well center.

Figure 20:
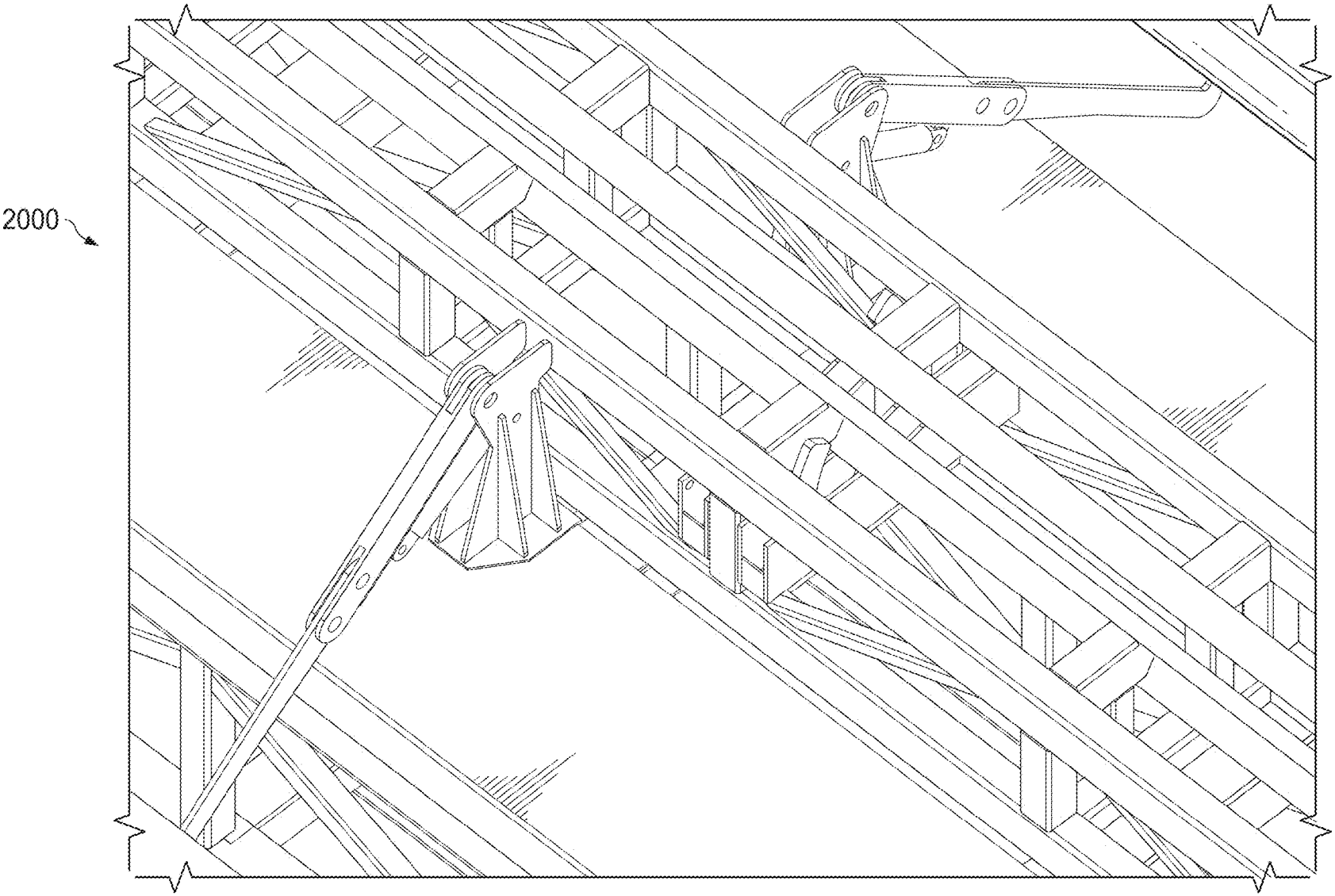
FIG. 20 is a diagram of a system for movement of pipe or casing joint assemblies, in accordance with an example embodiment of the present disclosure.

FIG. 20 is a diagram of a system 2000 for movement of pipe or casing joint assemblies, in accordance with an example embodiment of the present disclosure. The process as described can be used for running pipe or casing into the well, but the system can be reversed and used to remove drill pipe from the well. The made-up stand can be lowered onto the delivery catwalk and kickers can be used to kick the pipe out for installation onto the casing feed and bucking skid 104. The tong can break out each section and kick it onto the tiering racks 106. The loader can then be used to remove the pipe from location and transported to the next wellsite.

Figure 21:
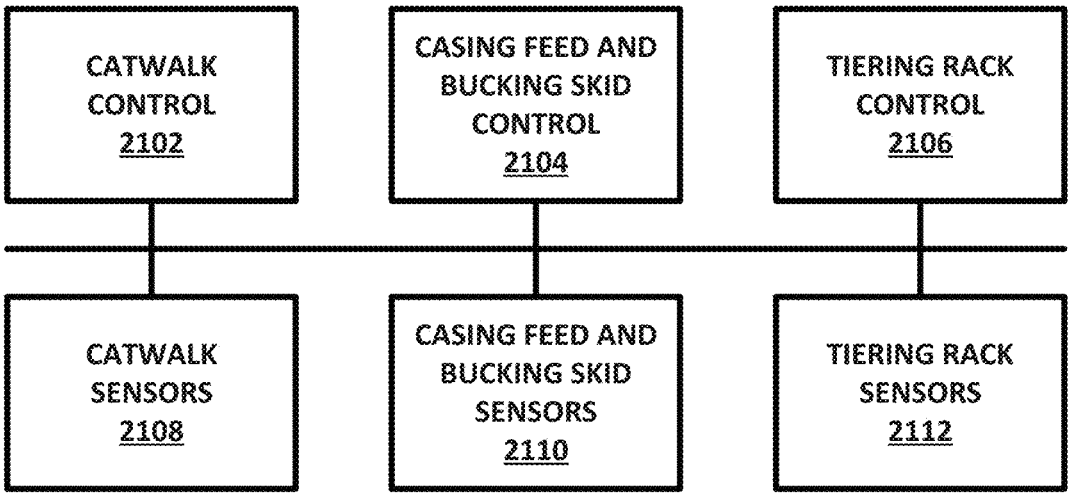
FIG. 21 is a diagram of a system for controlling a pipe or casing section assembly process, in accordance with an example embodiment of the present disclosure.

FIG. 21 is a diagram of a system 2100 for controlling a pipe or casing section assembly process, in accordance with an example embodiment of the present disclosure. System 2100 includes catwalk control 2102, casing feed and bucking skid control 2104, tiering rack control 2106, catwalk sensors 2108, casing feed and bucking skid sensors 2110 and tiering rack sensors 2112, each of which can be implemented in hardware or a suitable combination of hardware and software.

Catwalk control 2102 can be implemented as one or more algorithms operating on logic devices, a programmable industrial control processor or in other suitable manners. In one example embodiment, catwalk control 2102 can receive one or more sensor inputs or user commands from a user interface device or control, and can modify an operational state of tubular delivery catwalk 102. In one example embodiment, tubular delivery catwalk 102 can be raised or lowered by catwalk control 2102, one or more hydraulic or DC control motor actuators of tubular delivery catwalk 102 can be operated in response to catwalk control 2102, or other suitable functions can be performed, such as those discussed herein.

Casing feed and bucking skid control 2104 can be implemented as one or more algorithms operating on logic devices, a programmable industrial control processor or in other suitable manners. In one example embodiment, casing feed and bucking skid control 2104 can receive one or more sensor inputs or user commands from a user interface device or control, and can modify an operational state of casing feed and bucking skid 104. In one example embodiment, casing feed and bucking skid 104 can be moved by casing feed and bucking skid control 2104, one or more hydraulic or DC control motor actuators of casing feed and bucking skid control 2104 can be operated in response to casing feed and bucking skid 104, or other suitable functions can be performed, such as those discussed herein.

Tiering rack control 2106 can be implemented as one or more algorithms operating on logic devices, a programmable industrial control processor or in other suitable manners. In one example embodiment, tiering rack control 2106 can receive one or more sensor inputs or user commands from a user interface device or control, and can modify an operational state of tiering rack 106. In one example embodiment, tiering rack 106 can be raised or lowered by tiering rack control 2106, one or more hydraulic or DC control motor actuators of tubular tiering rack 106 can be operated in response to tiering rack control 2106, or other suitable functions can be performed, such as those discussed herein.

Catwalk sensors 2108 can be implemented in hardware or a suitable combination of hardware and software, and can include one or more motion sensors, weight sensors, limit sensors, location sensors or other suitable sensors. Catwalk sensors 2108 can be used to generate sensor data that is transmitted to catwalk control 2102 to facilitate the automated operations discussed herein, such as raising or lowering of pipe or casing supports, movement of pipe or casing and other suitable functions.

Casing feed and bucking skid sensors 2110 can be implemented in hardware or a suitable combination of hardware and software, and can include one or more motion sensors, weight sensors, limit sensors, location sensors or other suitable sensors. Casing feed and bucking skid sensors 2110 can be used to generate sensor data that is transmitted to casing feed and bicking skid control 2104 to facilitate the automated operations discussed herein, such as raising or lowering of pipe or casing supports, movement of pipe or casing and other suitable functions.

Tiering rack sensors 2112 can be implemented in hardware or a suitable combination of hardware and software, and can include one or more motion sensors, weight sensors, limit sensors, location sensors or other suitable sensors. Tiering rack sensors 2112 can be used to generate sensor data that is transmitted to tiering rack control 2112 to facilitate the automated operations discussed herein, such as raising or lowering of pipe or casing supports, movement of pipe or casing and other suitable functions.

Figure 22:
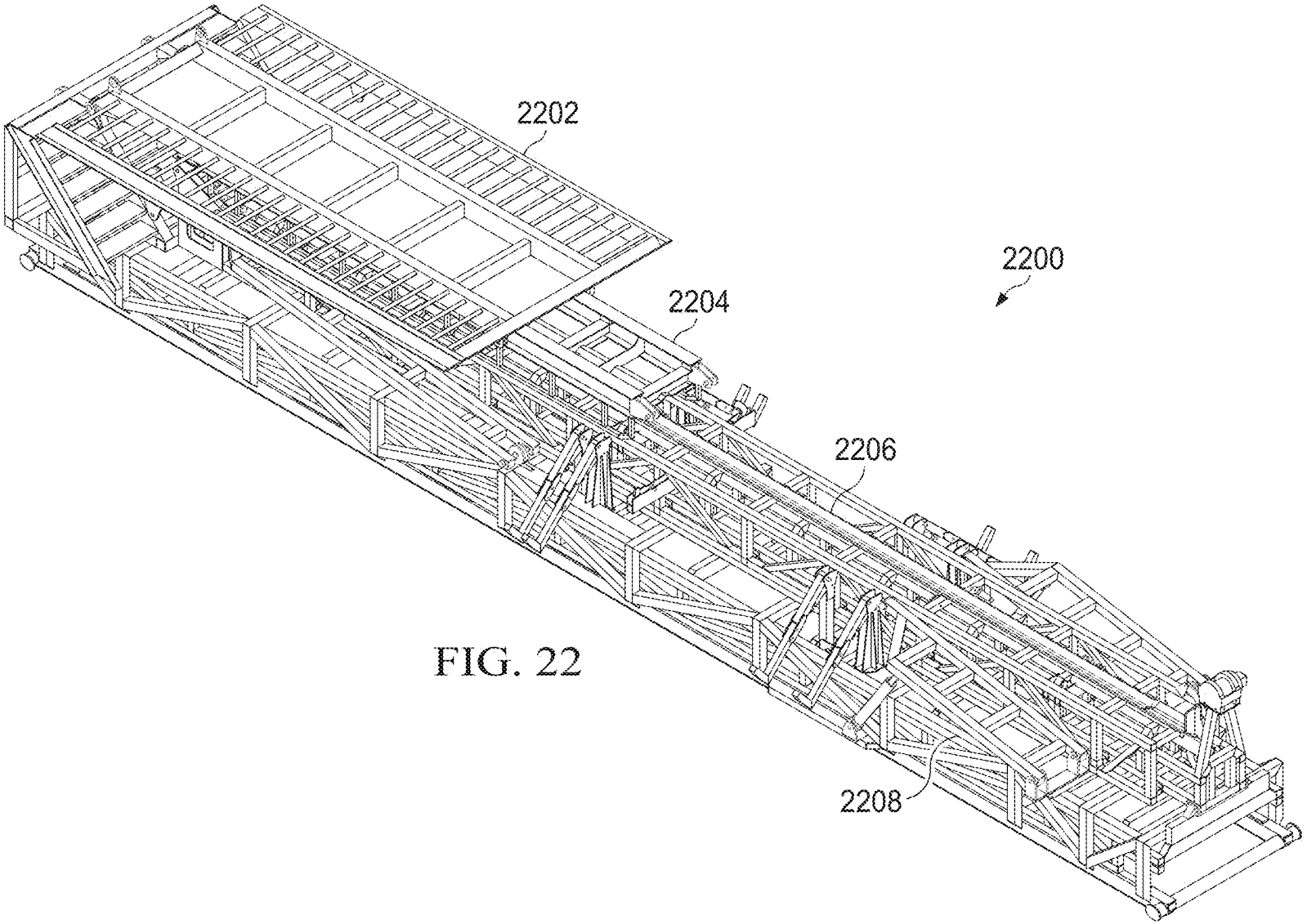
FIG. 22 is a diagram of a system for movement of pipe or casing joint assemblies in a transport configuration, in accordance with an example embodiment of the present disclosure.

FIG. 22 is a diagram of a system 2200 for movement of pipe or casing joint assemblies in a transport configuration, in accordance with an example embodiment of the present disclosure. System 2200 includes fold-over door 2202, inner frame top portion 2204, inner frame bottom portion 2206 and outer frame 2208, each of which can be fabricated from steel, iron, carbon steel, other suitable metals, other suitable materials or a suitable combination of materials, from hydraulic components, electrical controls and other suitable materials as discussed and described herein.

Fold-over door 2202 is configured to fold over on top of inner frame top portion 2204 and outer frame 2208, so as to facilitate transportation of system 2200. In one example embodiment, fold-over door 2202 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame top portion 2204 is configured to telescope within outer frame 2208, so as to facilitate transportation of system 2200. In one example embodiment, inner frame top portion 2204 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame bottom portion 2206 is configured to telescope within outer frame 2208, so as to facilitate transportation of system 2200. In one example embodiment, inner frame bottom portion 2206 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Outer frame 2208 is configured to hold inner frame bottom portion 2202 and inner frame top portion 2204, to allow them to telescope into position, and can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used. Outer frame 2208 can be fabricated in multiple sections, such as a first outer frame section for inner frame bottom portion 2202 and a second outer frame portion for inner frame top portion 2204, or in other suitable manners.

Figure 23:
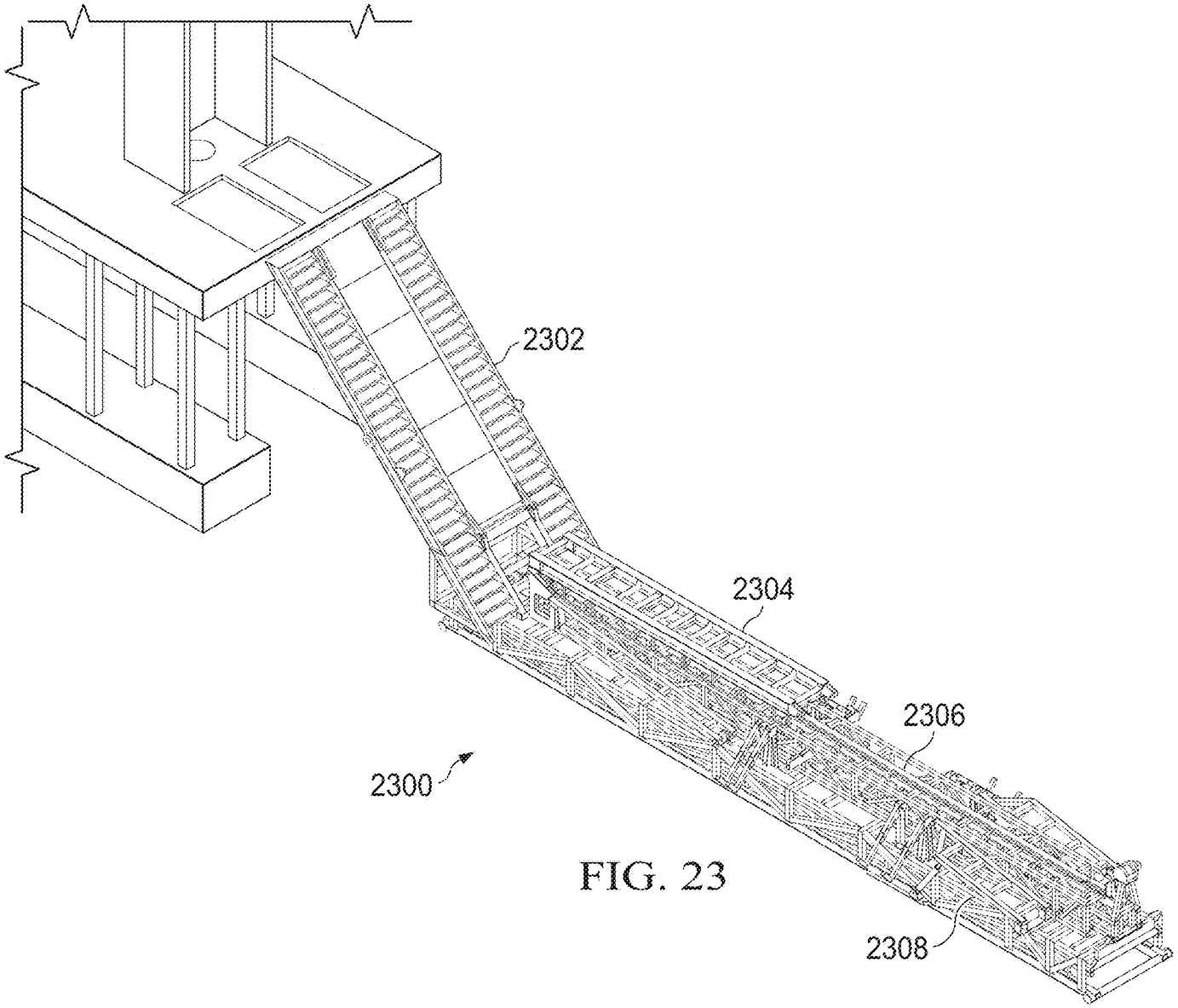
FIG. 23 is a diagram of a system for movement of pipe or casing joint assemblies in a first assembly stage, in accordance with an example embodiment of the present disclosure.

FIG. 23 is a diagram of a system 2300 for movement of pipe or casing joint assemblies in a first assembly stage, in accordance with an example embodiment of the present disclosure. System 2300 includes fold-over door 2302, inner frame top portion 2304, inner frame bottom portion 2306 and outer frame 2308, each of which can be fabricated from steel, iron, carbon steel, other suitable metals, other suitable materials or a suitable combination of materials, from hydraulic components, electrical controls and other suitable materials as discussed and described herein.

Fold-over door 2302 is shown resting on a drilling rig floor. In one example embodiment, fold-over door 2302 is automatically deployed in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame top portion 2304 is configured to telescope within outer frame 2308, so as to facilitate transportation of system 2300. In one example embodiment, inner frame top portion 2304 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame bottom portion 2306 is configured to telescope within outer frame 2308, so as to facilitate transportation of system 2300. In one example embodiment, inner frame bottom portion 2306 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Outer frame 2308 is configured to hold inner frame bottom portion 2302 and inner frame top portion 2304, to allow them to telescope into position, and can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used. Outer frame 2308 can be fabricated in multiple sections, such as a first outer frame section for inner frame bottom portion 2302 and a second outer frame portion for inner frame top portion 2304, or in other suitable manners.

Figure 24:
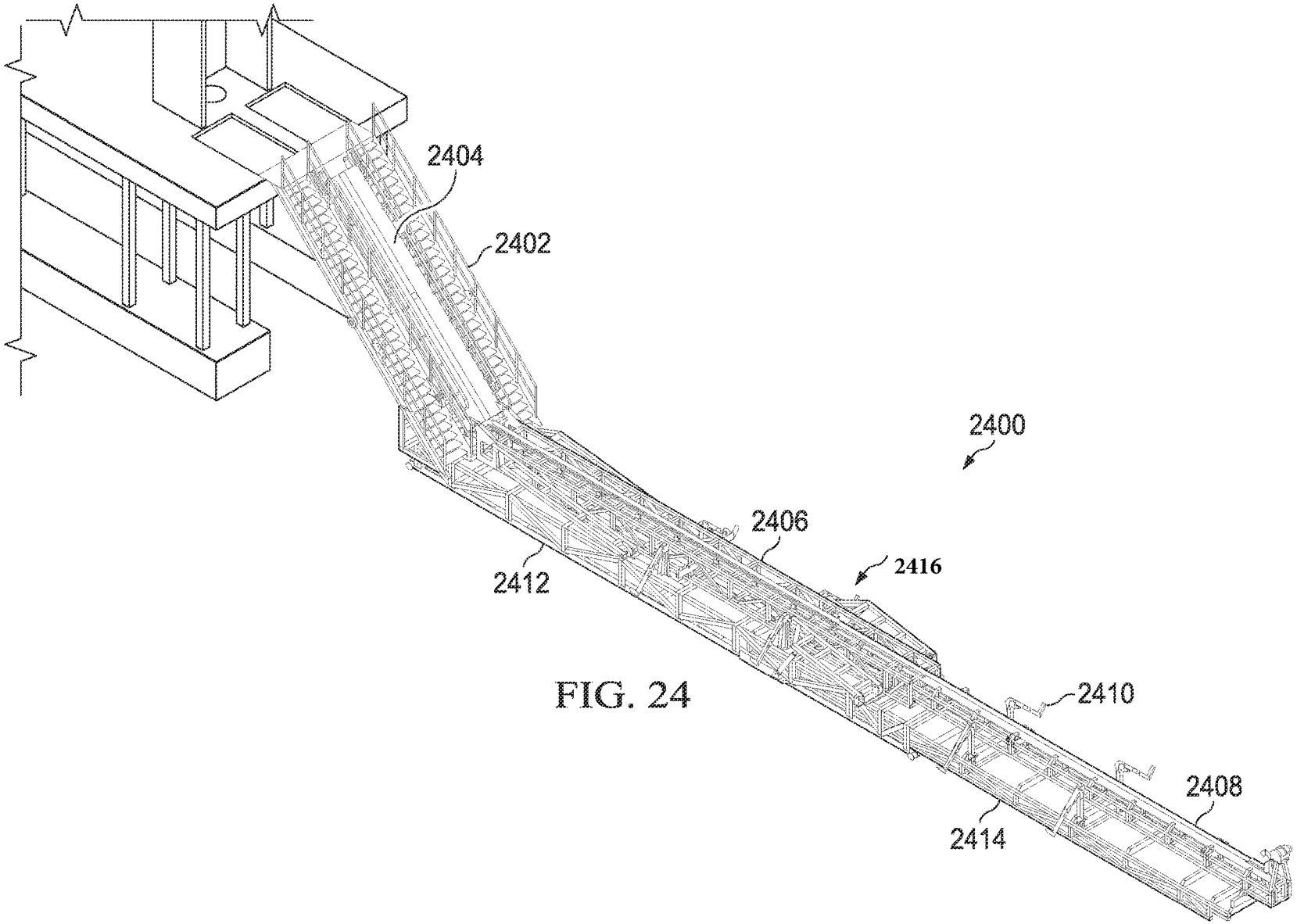
FIG. 24 is a diagram of a system for movement of pipe or casing joint assemblies in a second assembly stage, in accordance with an example embodiment of the present disclosure.

FIG. 24 is a diagram of a system 2400 for movement of pipe or casing joint assemblies in a second assembly stage, in accordance with an example embodiment of the present disclosure. System 2400 includes deployed fold-over door 2402, inner frame top portion 2404, outer frame top portion 2406, inner frame top portion 2408, loading arms 2410, outer frame bottom portion 2412 and inner frame bottom portion 2414, each of which can be fabricated from steel, iron, carbon steel, other suitable metals, other suitable materials or a suitable combination of materials, from hydraulic components, electrical controls and other suitable materials as discussed and described herein.

Deployed fold-over door 2402 is shown resting on a drilling rig floor, with deployed handrails. In one example embodiment, deployed fold-over door 2402 and its associated had rails are automatically deployed in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame top portion 2404 includes guard rails that are deployed inside of the guard rails of deployed fold-over door 2402, and provide additional security for personnel working on the drilling rig. In one example embodiment, inner frame top portion 2404 and its guard rails are automatically deployed in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Outer frame top portion 2406 is configured to support inner frame bottom portion 2408 and to contain an inner frame, after inner frame bottom portion 2408 has telescoped into position, and can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used. Outer frame to portion 2406 can be fabricated in multiple sections, such as a first outer frame section for inner frame bottom portion 2408 and a second outer frame portion for an inner frame top portion, or in other suitable manners.

Inner frame top portion 2408 is extended from and supported by outer frame top portion 2406. In one example embodiment, inner frame bottom portion 2414 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Loading arms 2410 can be separately controlled using a programmable controller, manual controls, a combination of controls or in other suitable manners, and can use hydraulic power, electric power or other suitable power sources to operate. In one example embodiment, loading arms 2410 can include robotic controls, can have one or more predetermined movement functions (e.g. a first movement function to move from a transport configuration to a loading configuration, a second movement function to move a pipe from a loading position to a fabrication position and a third movement function to return to the loading position after the pipe has been fabricated), or other suitable controls. Loading arms 2410 can be actuated to lower the casing or pipe section onto the frame of a casing feed and bucking skid at a desired elevation, such as by operating loading arms 2410 under algorithmic control, and in response to one or more sensors that are activated when the casing or pipe section has reached a predetermined location. In another example embodiment, one or more manual controls can be activated once the casing or pipe section has reached a predetermined location, or other suitable processes can also or alternatively be used.

Outer frame bottom portion 2412 is part of system 2400, and is disposed underneath outer frame top portion 2406, inner frame top portion 2408, loading arms 2410 and inner frame bottom portion 2414, as shown in FIG. 24. Loading arms 2410 can be actuated to lower the casing or pipe section onto the frame of a casing feed and bucking skid system 2416 at a desired elevation, wherein the casing feed and bucking skid system 2416 (formed by outer frame top portion 2406, inner frame top portion 2408, loading arms 2410, outer frame bottom portion 2412 and inner frame bottom portion 2414), further comprises an outer frame (such as outer frame bottom portion 2412 or other suitable components) configured to support a plurality of elements, such as by operating loading arms 2410 under algorithmic control, and in response to one or more sensors that are activated when the casing or pipe section has reached a predetermined location.

Inner frame bottom portion 2414 is part of system 2400 and is disposed underneath outer frame top portion 2406, inner frame top portion 2408 and loading arms 2410 and below outer frame bottom portion 2412, as shown in FIG. 24. Loading arms 2410 can be actuated to lower the casing or pipe section onto the frame of a casing feed and bucking skid system 2416 (formed by outer frame top portion 2406, inner frame top portion 2408, loading arms 2410, outer frame bottom portion 2412 and inner frame bottom portion 2414) at a desired elevation, wherein the casing feed and bucking skid system 2416 further comprises an outer frame (such as outer frame bottom portion 2412 or other suitable components) configured to support an inner frame (such as inner frame top portion 2412 or other suitable components), and wherein the inner frame is configured to extend from the outer frame as shown, and in response to one or more sensors that are activated when the casing or pipe section has reached a predetermined location. The casing feed and bucking skid system as shown in FIG. 24 or elsewhere can further comprise an upper outer frame, a lower outer frame and an inner frame disposed within the upper outer frame and configured to extend from the upper outer frame. The casing feed and bucking skid system as shown in FIG. 24 or elsewhere can alternatively further comprise an upper outer frame (such as outer frame top portion 2406 or other suitable components), a lower outer frame (such as outer frame bottom portion 2412 or other suitable components), an upper inner frame (such as inner frame top portion 2408 or other suitable components) disposed within the upper outer frame and configured to extend from the upper outer frame and a lower inner frame disposed within the lower outer frame and configured to extend from the lower outer frame. The casing feed and bucking skid system as shown in FIG. 24 or elsewhere can further comprise an upper frame, a lower frame and one or more supports configured to elevate the upper frame above the lower frame. The casing feed and bucking skid system as shown in FIG. 24 or elsewhere can further comprise a handrail having a first position for storage during transport and a second position for processing tubular components.

Figure 25:
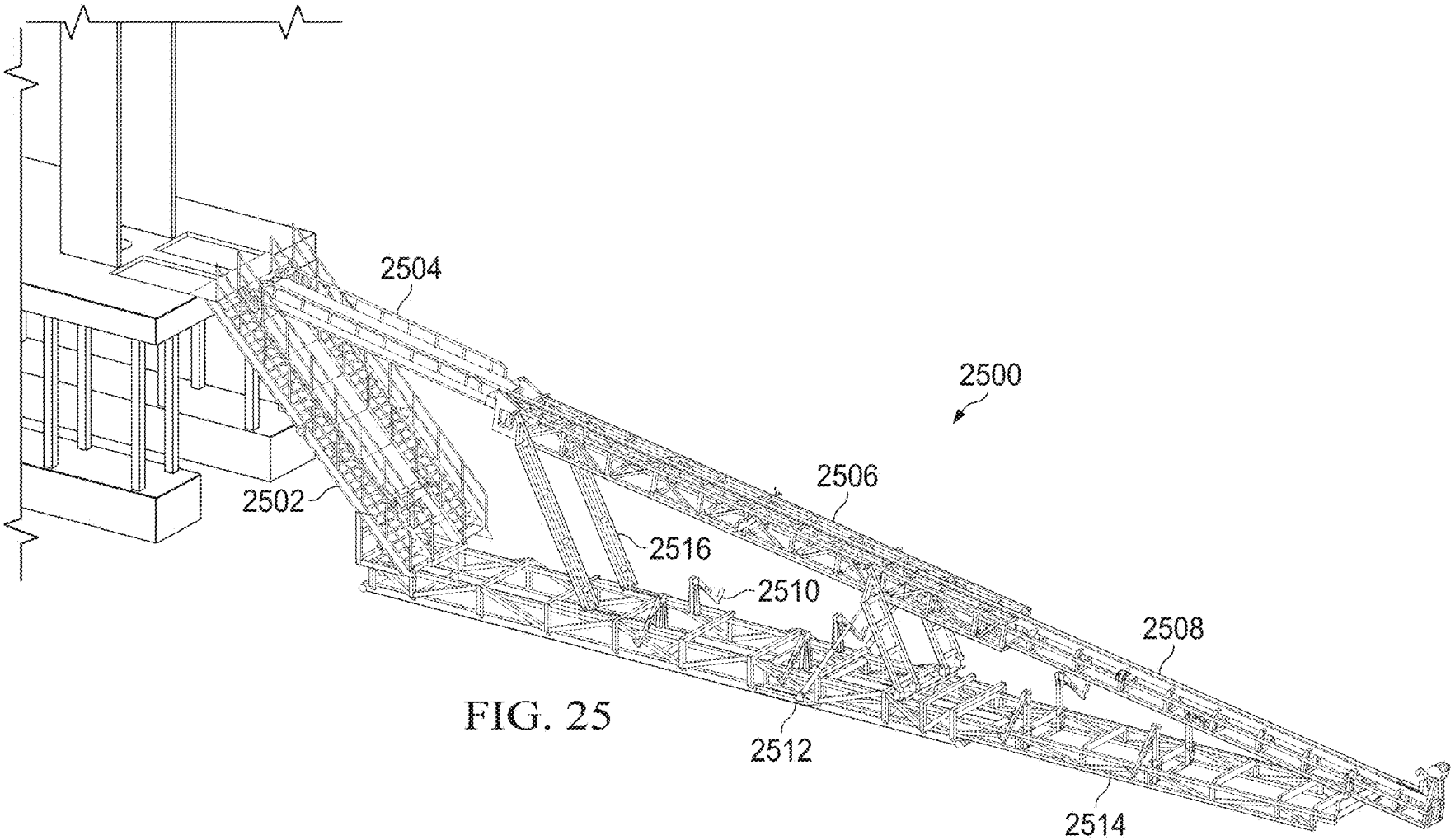
FIG. 25 is a diagram of a system for movement of pipe or casing joint assemblies in a third assembly stage, in accordance with an example embodiment of the present disclosure.

FIG. 25 is a diagram of a system 2500 for movement of pipe or casing joint assemblies in a third assembly stage, in accordance with an example embodiment of the present disclosure. System 2500 includes fold-over door 2502, inner frame top portion 2504, outer frame top portion 2506, inner frame top portion 2508, loading arms 2510, outer frame bottom portion 2512, inner frame bottom portion 2514 and supports 2516, each of which can be fabricated from steel, iron, carbon steel, other suitable metals, other suitable materials or a suitable combination of materials, from hydraulic components, electrical controls and other suitable materials as discussed and described herein.

Fold-over door 2502 is shown resting on drilling rig floor with deployed handrails. In one example embodiment, fold-over door 2502 is automatically deployed in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Inner frame top portion 2504 is shown deployed with a fabricated tubular in delivery position to the drilling rig floor. In one example embodiment, inner frame top portion 2504 can assist with the delivery of the fabricated tubular with one or more powered rollers or other suitable devices.

Outer frame top portion 2506 provides support for inner frame top portion 2504 and inner frame top portion 2508, to allow them to telescope into position for fabrication and delivery of tubulars, such as casing, drilling pipe and other suitable components. In one example embodiment, outer frame top portion 2506 can include motive force devices, can be configured to interact with supports 2516 to allow it to be automatically deployed, and can perform other suitable functions.

Inner frame top portion 2508 provides support for a constructed tubular and extends from outer frame top portion 2506. In one example embodiment, inner frame top portion 2508 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Loading arms 2510 can be separately controlled using a programmable controller, manual controls, a combination of controls or in other suitable manners, and can use hydraulic power, electric power or other suitable power sources to operate. In one example embodiment, loading arms 2510 can include robotic controls, can have one or more predetermined movement functions (e.g. a first movement function to move from a transport configuration to a loading configuration, a second movement function to move a pipe from a loading position to a fabrication position and a third movement function to return to the loading position after the pipe has been fabricated), or other suitable controls. Loading arms 2510 can be actuated to lower the casing or pipe section onto the frame of a casing feed and bucking skid at a desired elevation, such as by operating loading arms 2510 under algorithmic control, and in response to one or more sensors that are activated when the casing or pipe section has reached a predetermined location. In another example embodiment, one or more manual controls can be activated once the casing or pipe section has reached a predetermined location, or other suitable processes can also or alternatively be used.

Outer frame bottom portion 2512 and inner frame bottom portion 2514 provide additional support for tubular production and delivery. In one example embodiment, outer frame top portion 2512 and inner frame bottom portion 2514 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

Supports 2516 are configured to lift outer frame top portion 2506, inner frame top portion 2504, inner frame top portion 2508 and a constructed tubular to allow the constructed tubular to be delivered to the drilling rig. In one example embodiment, supports 2516 can be configured to automatically deploy in response to a control, such as by using one or more hydraulic actuators, one or more electrical actuators or other suitable actuators. Likewise, a release latch can be mechanically or electrically actuated to facilitate manual deployment, an indicator can be actuated or other suitable systems and processes can also or alternatively be used.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

As used herein, "hardware" can include a combination of discrete components, an integrated circuit, an application-specific integrated circuit, a field programmable gate array, or other suitable hardware. As used herein, "software" can include one or more objects, agents, threads, lines of code, subroutines, separate software applications, two or more lines of code or other suitable software structures operating in two or more software applications, on one or more processors (where a processor includes one or more microcomputers or other suitable data processing units, memory devices, input-output devices, displays, data input devices such as a keyboard or a mouse, peripherals such as printers and speakers, associated drivers, control cards, power sources, network devices, docking station devices, or other suitable devices operating under control of software systems in conjunction with the processor or other devices), or other suitable software structures. In one exemplary embodiment, software can include one or more lines of code or other suitable software structures operating in a general purpose software application, such as an operating system, and one or more lines of code or other suitable software structures operating in a specific purpose software application. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. The term "data" can refer to a suitable structure for using, conveying or storing data, such as a data field, a data buffer, a data message having the data value and sender/receiver address data, a control message having the data value and one or more operators that cause the receiving system or component to perform a function using the data, or other suitable hardware or software components for the electronic processing of data.

In general, a software system is a system that operates on a processor to perform predetermined functions in response to predetermined data fields. A software system is typically created as an algorithmic source code by a human programmer, and the source code algorithm is then compiled into a machine language algorithm with the source code algorithm functions, and linked to the specific input/output devices, dynamic link libraries and other specific hardware and software components of a processor, which converts the processor from a general purpose processor into a specific purpose processor. This well-known process for implementing an algorithm using a processor should require no explanation for one of even rudimentary skill in the art. For example, a system can be defined by the function it performs and the data fields that it performs the function on. As used herein, a NAME system, where NAME is typically the name of the general function that is performed by the system, refers to a software system that is configured to operate on a processor and to perform the disclosed function on the disclosed data fields. A system can receive one or more data inputs, such as data fields, user-entered data, control data in response to a user prompt or other suitable data, and can determine an action to take based on an algorithm, such as to proceed to a next algorithmic step if data is received, to repeat a prompt if data is not received, to perform a mathematical operation on two data fields, to sort or display data fields or to perform other suitable well-known algorithmic functions. Unless a specific algorithm is disclosed, then any suitable algorithm that would be known to one of skill in the art for performing the function using the associated data fields is contemplated as falling within the scope of the disclosure. For example, a message system that generates a message that includes a sender address field, a recipient address field and a message field would encompass software operating on a processor that can obtain the sender address field, recipient address field and message field from a suitable system or device of the processor, such as a buffer device or buffer system, can assemble the sender address field, recipient address field and message field into a suitable electronic message format (such as an electronic mail message, a TCP/IP message or any other suitable message format that has a sender address field, a recipient address field and message field), and can transmit the electronic message using electronic messaging systems and devices of the processor over a communications medium, such as a network. One of ordinary skill in the art would be able to provide the specific coding for a specific application based on the foregoing disclosure, which is intended to set forth exemplary embodiments of the present disclosure, and not to provide a tutorial for someone having less than ordinary skill in the art, such as someone who is unfamiliar with programming or processors in a suitable programming language. A specific algorithm for performing a function can be provided in a flow chart form or in other suitable formats, where the data fields and associated functions can be set forth in an exemplary order of operations, where the order can be rearranged as suitable and is not intended to be limiting unless explicitly stated to be limiting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A system for assembling drilling tubulars, comprising:

a tiering rack system having two or more actuators configured to receive a plurality of sections of drilling tubulars and to selectively provide an individual drilling tubular section to a loading area using the two or more actuators;

a casing feed and bucking skid system coupled to the tiering rack system, the casing feed and bucking skid system 1) having the loading area, 2) having a plurality of loading arms configured to operate in unison to translocate the individual drilling tubular section and 3) configured to receive the individual drilling tubular section and to combine the individual drilling tubular section with a second individual drilling tubular section; and a tubular delivery catwalk system coupled to the casing feed and bucking skid system and configured to receive the combined drilling tubular sections and to transport the combined drilling tubular sections to a drilling rig by elevating on at least two elevating supports.

2. The system of claim 1 further comprising a controller coupled to the tiering rack system, the casing feed and bucking skid system and the tubular delivery catwalk system and to control an interoperation of the tiering rack system, the casing feed and bucking skid system and the tubular delivery catwalk system.

3. The system of claim 1 wherein the tubular delivery catwalk system further comprises an outer frame configured to support a plurality of elements.

4. The system of claim 1 wherein the tubular delivery catwalk system further comprises an outer frame configured to support an inner frame, and wherein the inner frame is configured to extend from the outer frame.

5. The system of claim 1 wherein the tubular delivery catwalk system further comprises:

an upper outer frame;

a lower outer frame; and an inner frame disposed within the upper outer frame and configured to extend from the upper outer frame.

6. The system of claim 1 wherein the casing feed and bucking skid system further comprises:

an upper outer frame;

a lower outer frame;

an upper inner frame disposed within the upper outer frame and configured to extend from the upper outer frame; and a lower inner frame disposed within the lower outer frame and configured to extend from the lower outer frame.

7. The system of claim 1 wherein the casing feed and bucking skid system further comprises a plurality of loading arms having a first position for storage during transport and a second position for processing tubular components.

8. The system of claim 1 wherein the tubular delivery catwalk system further comprises an upper frame, a lower frame and one or more supports configured to elevate the upper frame above the lower frame.

9. The system of claim 1 wherein the tubular delivery catwalk system further comprises a handrail having a first position for storage during transport and a second position for processing tubular components.

10. A method for assembling drilling tubulars, comprising:

configuring a tiering rack system having two or more actuators to receive a plurality of sections of drilling tubulars and to selectively provide an individual drilling tubular section to a loading area using the two or more actuators;

configuring a casing feed and bucking skid system coupled to the tiering rack system to receive the individual drilling tubular section, the casing feed and bucking skid system 1) having the loading area, 2) having a plurality of loading arms configured to operate in unison to translocate the individual drilling tubular section and 3) configured to combine the individual drilling tubular section with a second individual drilling tubular section; and configuring a tubular delivery catwalk system coupled to the casing feed and bucking skid system to receive the combined drilling tubular sections and to transport the combined drilling tubular sections to a drilling rig by elevating the combined tubular sections on at least two elevating supports.

11. The method of claim 10 further comprising controlling the tiering rack system, the casing feed and bucking skid system and the tubular delivery catwalk system with a controller that is configured to control an interoperation of the tiering rack system, the casing feed and bucking skid system and the tubular delivery catwalk system.

12. The method of claim 10 further comprising configuring an outer frame of a tubular delivery catwalk system to support a plurality of elements.

13. The method of claim 10 further comprising configuring an outer frame of a tubular delivery catwalk system to support an inner frame and to extend the inner frame from the outer frame.

14. The method of claim 10 further comprising extending an upper inner frame of a tubular delivery catwalk system from an upper outer frame.

15. The method of claim 10 further comprising:

extending an upper inner frame of a tubular delivery catwalk system from an upper outer frame; and extending a lower inner frame of the tubular delivery catwalk system from a lower outer frame.

16. The method of claim 10 further comprising deploying a plurality of loading arms from a first position for storage during transport to a second position for processing tubular components.

17. The method of claim 10 further comprising elevating an upper frame of a tubular delivery catwalk system above a lower frame using a plurality of supports.

18. The method of claim 10 further comprising deploying a handrail from a first position for storage during transport to a second position for processing tubular components.

* * * * *